US007788312B2

(12) United States Patent
Vigoda

(10) Patent No.: US 7,788,312 B2
(45) Date of Patent: Aug. 31, 2010

(54) APPARATUS AND METHOD FOR REDUCING ERRORS IN ANALOG CIRCUITS WHILE PROCESSING SIGNALS

(75) Inventor: Benjamin Butterfly William Vigoda, Somerville, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 895 days.

(21) Appl. No.: 11/625,133

(22) Filed: Jan. 19, 2007

(65) Prior Publication Data

US 2008/0174460 A1 Jul. 24, 2008

(51) Int. Cl.
*G06G 7/00* (2006.01)

(52) U.S. Cl. ..... 708/801

(58) Field of Classification Search ..... 708/801
See application file for complete search history.

(56) References Cited

U.S. PATENT DOCUMENTS

| | | | | |
|---|---|---|---|---|
| 4,586,155 | A | 4/1986 | Gilbert | |
| 5,113,367 | A * | 5/1992 | Marrian et al. | 708/813 |
| 5,495,554 | A | 2/1996 | Edwards | |
| 6,282,559 | B1 | 8/2001 | Helfenstein | |
| 6,954,423 | B2 | 10/2005 | Tinker | |
| 7,006,267 | B2 | 2/2006 | Franson | |
| 7,071,846 | B2 | 7/2006 | Moerz | |
| 7,131,054 | B2 | 10/2006 | Greenberg | |
| 2003/0204382 | A1 * | 10/2003 | Julier et al. | 702/196 |

OTHER PUBLICATIONS

D.B. Kirk: "Accurate and Precise Computation Using Analog VLSI, with Applications to Computer Graphics and Neutral Networks" Mar. 16, 1993, California Institute of Technology, XP007904905; URL: http://resolver.caltech.edu/CaltechCSTR:1993.cs-tr-93-08>.

F. Lustenberger: "On the Design of Analog VLSI Iterlative Decoders" [Online] Nov. 2000, Eidgenossische Technische Hochschule (ETH) Zurich, XP007900561, Http://e-collection.ethbib.ethz.ch/view/eth:23744.

B. Vigoda: "Analog Logic: Continuous-Time Analog Circuits for Statistical Signal Processing" [Online] Sep. 2003, Massachusetts Institute of Technology, XP007904886; URL: http;//media.mit.edu/physics/publications/theses/03.07.vigoda.pdf.

Hans-Andreas Loeliger, "Analog decoding and beyond ," Information Theory Workshop, 2001. Proceedings, ISBN: 0/7803-7119-4, 2001 IEEE, pp. 126-127, Sep. 2001.

Donald A. Gaubatz, in "FFT-Based Analog Beam-forming Processor" Ultrasonics Symposium Proceedings, pp. 676-681, 1976.

Felix Lustenberger and Hans-Andrea Loeliger, "On Mismatch Errors In Analog-VLSI Error Correcting Decoders," Proceedings of ISCAS, May 2001.

Seth Lloyd and Jean-Jacques Slotine, "Analog Quantum Error Correction," Physical Review Letters 80, 4088-4091, Issue 18, May 1998.

* cited by examiner

*Primary Examiner*—Tan V Mai
(74) *Attorney, Agent, or Firm*—Dirk Brinkman; Gene Vinokur

(57) ABSTRACT

A method and apparatus processes signals in a set of analog circuit components of an analog circuit white enforcing a set of explicit constraints corresponding to a set of implicit constraints to reduce errors in output signals.

135 Claims, 22 Drawing Sheets

APPARATUS AND METHOD FOR REDUCING ERRORS IN ANALOG CIRCUITS WHILE PROCESSING SIGNALS

FIELD OF THE INVENTION

The present invention relates generally to a method and apparatus for processing analog signals in analog circuits, and more particularly to reducing the effect of errors while processing the analog signals.

BACKGROUND OF THE INVENTION

The Past

There is an important difference between analog and digital circuits, especially when the circuits are used for complex computations and other complex processing. Analog circuits are primarily subject to the laws of physics, while digital circuits must obey the rules of logic. This has numerous implications.

At one time, all electrical devices, such telephones, radios, televisions used analog circuits. Even the first computers were analog. Generally, analog circuits are faster, less complex, use less power, and are smaller in size than equivalent digital circuits to perform similar processing tasks. But, perhaps most important, analog circuits can operate on analog values and analog states that represent, for example, real or complex numbers.

However, analog circuits have a major disadvantage when compared with digital circuits. Analog circuits are more prone to errors than, digital circuits. This is because analog circuits are relatively susceptible to noise, uncontrollable variations in fabrication processes, systematic or non-systematic faults, parasitic effects, defects, component mismatch, offsets, non-linearities, and sometimes hard to control environmental conditions. This makes it difficult to use analog circuits in the mass production of large complex systems, as demanded for modern electronic devices.

Consequently, digital circuits are now ubiquitous, filling an insatiable consumer market. Computers came first, later followed by digital telephones, television and radio, and innumerable other electronic digital devices. However, digital circuits also have disadvantages. When compared with analog circuits, digital circuits are relatively slow. But more important, digital circuits can only operate on discrete values, for example, 0 and 1. This requires that the input signals need first to sampled and quantized. Switching between permissible discrete states in digital circuits also takes more time than smoothly slewing analog states that have close together values in an analog circuit, The Present Herein, error correction and error reduction are distinguished. Error correcting codes and error correcting decoders work together to form a system for removing errors from data that has been corrupted by being sent across a noisy channel. The existence of error correcting codes was described by Claude Shannon in 1958 when he proved his well known channel capacity theorem. The first examples of error correcting codes were described by Hamming in 1960, Recently the field of coding was revolutionized when turbo codes and then low-density parity check (LDPC) codes were shown to both achieve very close to the Shannon channel capacity and to be decodable by relatively low-complexity error correction decoding algorithms. So called soft decoders are in fact these low-complexity error-correction decoders for turbo codes and LDPC codes. Soft decoders have been implemented with analog circuits, and have been shown to correct noise introduced by a noisy channel. For this to be possible, however, the data sent through the channel must first be encoded using an error correcting code. Those analog error correction decoders do not correct noise introduced by the circuit itself, they only correct errors due to channel noise. Error reduction is distinguished below.

Errors in Analog Circuits

Hans-Andreas Loeliger states that, "It is commonplace that analog circuits are sensitive to noise, temperature, and component variations, and are therefore hard to design and expensive to manufacture." Hans-Andreas Loeliger, "Analog decoding and beyond," Information Theory Workshop, 2001. Proceedings, ISBN: 0-7803-7119-4, 2001 IEEE, pp. 126-127, September 2001. He goes on to state that, "it has always been known that analog computation is sometimes much faster or less power consuming than digital computation," and that "indeed, Carver Mead has demonstrated unconventional adaptive analog systems for a number of signal processing tasks (primarily in image processing) that share the robustness of digital systems but use several orders of magnitude less power," and finally that "the most interesting modes of analog computation, may yet remain to be discovered."

Analog Fast-Fourier Transform

Donald A. Gaubatz, in "FFT-Based Analog Beam-forming Processor" Ultrasonics Symposium Proceedings, pages 676-681, 1976, describes an example of processing with analog circuits. Gaubatz states that, "Analog signal processing requires stringent design constraints to assure accuracy and repeatability, but the resulting speed and relative economy are compensating factors." Although Gaubatz describes a method for implementing a fast Fourier transform (FFT) with analog circuits, "the stringent design constraints" he employs to "assure accuracy" is to tediously selected discrete devices, each on its own die and in its own package, and to test each device to assure that the device matches the other devices before using the device in the FFT. Clearly, that technique is not amenable to mass production.

Transistor mismatch can be due to transistors being manufactured either too large or too small in either width or length, by variations in the distribution of dopant atoms from transistor to transistor, by variations in oxide thickness, or by other causes. Gaubatz proposes to use discrete transistors so that each, transistor can be tested individually. He discards individual devices that do not match one another sufficiently. However, analog circuits manually constructed from a large set of individual discrete components are not cost competitive with modern, very-large-scale digital integrated circuits.

It would be impossible to implement Gaubatz's analog FFT circuit in modern integrated circuits, because an integrated version, would not be able to employ his tedious method of only using matching devices, and discarding mismatched devices.

In successive generations of integrated circuits, as transistors have been manufactured in smaller and smaller sizes, the effect of mismatch has increased because improvements in manufacturing tolerances have not kept up with deceased device scaling. For this reason, engineers designing integrated circuits often select to use integrated devices that are much larger than a minimum feature size of the process to avoid the worst effects of mismatch. This increases cost and power, and makes the circuits slower. The end result is that analog circuits do not benefit from Moore's law scaling, Analog designers can also use other methods to reduce mismatch errors. For example U.S. Pat. No. 4,386,155, "High-accuracy four-quadrant multiplier which also is capable of four-quadrant division" issued to Gilbert on Apr. 29, 1986, describes a four-quadrant analog multiplier. Gilbert describes a method for reducing errors introduced by temperature fluctuations in the circuit wherein "resistors are connected . . . and current which is proportional-to-absolute-temperature is caused to flow through the resistors. There, the resistors are laser-trimmed until $V_{BE}$ mismatch distortion is nulled." That method requires a separate circuit to measure the amount of mismatch or error due to temperature fluctuation, and to compensate by supplying additional current. Furthermore, in that method, resistors must be matched by laser trimming. Such methods are not suited for mass production, or very large scale integrated systems.

The Gaubatz method for assuring repeatability, in the presence of noise, is again to use large discrete devices operating at relatively large voltages, so that the average noise voltage in the circuit is small with respect to the overall voltage swing of the devices. As semiconductor fabrication processes improve and the size of transistors decreases, the supply voltage $V_{DD}$ also decreases. This means that the available voltage swing of devices decreases. However, the average noise-power does not decrease significantly. If a very small, low-power, integrated version of Gaubatz's circuits were manufactured in the attempt to be competitive against the power and area consumption of a digital circuit, the noise would be extremely disruptive to the processing because the average noise voltage would be equal to a significant percentage of the total voltage swing in the circuits.

U.S. Pat. No. 5,495,554, "Analog Wavelet Transform Circuitry," issued to R. Timothy Edwards and Michael D on Feb. 27, 1996, describes "an analog circuit implementing a continuous wavelet transform." That analog circuit is estimated to be about one-hundredth (1/100) the size and power of a digital wavelet transform circuit. Edwards et al. state that "the analog wavelet outputs of the analog wavelet transform chip is directly determined without the loss of information due to the digital sampling." They do not describe a method for reducing the effects of errors introduced in their analog processing.

U.S. Pat. No. 6,954,423, "Analog Implementation of Linear Transforms," issued to Frank A. Tinker on Oct. 11, 2005, describes a system that performs "a linear transformation of a data set of discrete values . . . provided as a set of analog signals to the input nodes." The transform "is achieved by judiciously adjusting the signal amplitude produced at the output of the phase-shift components and summing the resulting output signals as required to simulate the transformation of interest." They do not describe a method for reducing the effects of errors introduced in their analog processing.

The processes that can be used with the embodiments of the invention can include linear transforms, linearized transforms, unitary transforms, statistical inferences, normalized belief propagations, solving linear differential equations, solving linearized differential equations, matrix inverses, minimizing functions, or other functions that obey any conservation or scaling law.

Analog Processing of Error Correction Decoding for Communications

Like the FFT, error-correction decoding is an important and computationally intensive processing task performed by communication transceivers. Analog circuits for decoding error-correcting codes are known. In contrast to analog Viterbi decoders, the decoders are based on turbo codes described by factor graphs.

U.S. Pat. No. 7,071,846 "Analog Decoding Method and Decoder" issued to Moerz on Jul. 4, 2006, describes "an analog decoder," Moerz applies to parallelization of decoding of convolutional turbo codes. Error reduction is not described.

U.S. Pat. No. 6,282,559 "Method and electronic circuit for signal processing, in particular for the computation of probability distributions" issued to Helfenstein et al. on Aug. 28, 2001, describes a circuit module wherein "the currents of the outputs correspond to the product of the currents through the individual inputs. By combining the outputs, sum products can be calculated, especially for processing discrete probability distributions. The combination of several circuit modules allows to solve complex signal processing tasks." They do not describe a method for reducing the effects of errors introduced in their analog processing. The error correction decoder they describe only corrects the effects of errors introduced in the communication channel before the noisy signal enters the error correction decoder system. Noise and other errors introduced by the decoder itself are not addressed.

Although the circuits according to Loeliger et al. can perform error correction decoding of data received over a noisy channel, their circuits still suffer from internal errors introduced while the processing, see Felix Lustenberger and Hans-Andrea Loeliger, "On Mismatch Errors In Analog-VLSI Error Correcting Decoders," Proceedings of ISCAS, May 2001, They analyze their "new type of nonlinear analog transistor networks . . . proposed for 'turbo' decoding of error correcting codes." They state that, "the influence of various non-idealities on the performance of such analog decoders is not yet well understood." They describe "the performance degradation due to transistor mismatch." They "assume . . . that each transistor in the circuit is affected by transistor mismatch," and they "compare the accuracy of analog decoders with that of digital decoders," Again, Loeliger et al. only analyze the effect of mismatch, in the operation of the decoder circuit. They do not describe any method or apparatus to remedy the effects of mismatch in their circuits.

Loeliger et al. only analyze how to derive output-referred errors due to transistor mismatch in analog translinear circuits. Their circuits are capable of processing two probability distributions as inputs to produce a third probability distribution as an output. All inputs and outputs are discrete probability distributions, such as are commonly found in a histogram. In a probability distribution for a discrete stochastic variable, each possible discrete state of the variable is assigned a probability such that a sum of the probabilities that the variable is in any of its possible states is 100%. They represent the "analog" probability of a given discrete state of a variable as an analog current on a wire. Each discrete state that a variable may occupy is signaled on an associated wire. For example, for a binary variable that can be either zero or one, they use two wires where one wire signals the probability that the variable is a one, and the other wire signals the probability that the variable is a zero. Because that system uses wires carrying analog values, and devices that directly process these analog values, it is an analog circuit operating on discrete variables and states (0 or 1).

FIG. 2 is a schematic diagram of their circuit. In FIG. 2, inputs 200-201 are currents representing probability values of discrete state of a stochastic variables. Output currents are 202-205. Their circuit uses a voltage reference 206 that sets the DC offset for the corresponding input 211. Another voltage reference 207 sets the DC offset for the corresponding input 210. The circuit also includes sub-threshold-mode-MOSFETs 208-211, Transistor 209 takes the logarithm of the input current and produce a voltage that controls the gate of transistor 210. Transistor 208 takes the logarithm of the input current and produce a voltage that controls the gate of transistor 211. They only describe analog circuits using either subthreshold-mode-MOSFETs or BJTs. In fact, the circuit of FIG. 2 cannot perform the function they describe using any other kind of transistor.

They only describe circuits with exponential-components stating that, "the transistors will be modeled as exponentially behaving voltage controlled current sources." As described above, the use of exponential-components requires that the circuit be composed of either a set of MOSFETs operating in the below-threshold mode, or BJTs.

There are problems with those restrictions because MOSFETs operating in the below-threshold mode have the disadvantage of being very slow. Generally, MOSFETS cannot operate faster than a few hundred kHz, and usually only operate in the tens of kHz range. MOSFETs certainly cannot attain the more than GHz speeds achieved by above-threshold MOSFET devices employed in conventional digital processors. To make up for the slow speed, one can sometimes use more MOSFETs to operate in parallel. However, then leakage currents become an additional cause for errors, and the circuit size increases.

BJTs require a more complicated and more expensive manufacturing process than MOSFETs. Generally, BJT require quite a large amount of power and are also bigger than MOSFETs. Thus, BJTs require more semiconductor area. Primarily because of their much greater cost and manufacturing difficulty, BJTs are used infrequently in large-scale applications.

Errors in Digital Circuits

As stated above, digital circuits operate exclusively on discrete values and discrete states. Most often, 0 and 1. This makes it relatively easy to detect and correct errors, when compared with analog circuits. There are two basic methods for correcting errors introduced in digital circuits by any cause.

The first method is to use only discrete or "digital" states to represent information in the processing. In a binary digital circuit, a state must be a either zero or one in order to be considered a valid state. Comparators or comparator-like components in digital circuits force any state that is found to be in between zero and one to be made into a zero or one.

For example, if in a digital circuit ground GND=0, and a supply voltage $V_{DD}$=1V, then a state=0.6V cannot propagate through the circuit. Because the state is greater than 0.5V, the state is forced to $V_{DD}$ by the digital circuits, or failing this, the state may simply be considered invalid and the entire computation can fail. Errors in a digital, circuit cannot cause states to be greater than one, because a one is the same as $V_{DD}$ and a state cannot achieve a voltage greater than $V_{DD}$. Similarly, a state cannot achieve a voltage less than GND, so states cannot be less than zero. In this way, each individual bit in a digital computing circuit is always forced to be either $V_{DD}$ or GND, i.e., 1 or 0 respectively.

The second method for error correction, in digital processing due to noise deviations is to use error-correcting codes (ECC).

That method has always required the use of digital states. When using digital (binary) states or bits, the system can then make a copy of these bits or add parity check bits. Then, at some later time, the system can take advantage of the extra parity bits to detect and even correct errors that have been introduced.

Again, consider the digital circuit, which uses GND=0V and $V_{DD}$=1V. Strong noise, mismatch, or other kinds of defects can invert a zero state to a one state, or vice versa. For example, a state that should be at GND could end up at 0.6V because of noise. Then, the digital circuit forces the state to $V_{DD}$ because the state is greater than 0.5V. If bits are inverted in a computation, this can result in wrong answers or even in the digital computer failing to complete its task.

Error correcting codes have been used to successfully correct errors due to noise in channels. When using error-correcting codes, redundant bits are sent. That decreases throughput. This slow-down due to the redundant bits results in a lower channel capacity, a maximum, rate at which information can be sent across the channel.

Methods have been described for treating noise that affects bits in computing circuitry as if the noise were noise on the actual bits traversing the channel. In contrast to noisy channels, noise in digital computing circuits has somewhat worse consequences. Not only does the need to error correct in digital circuits result in a similar slowdown in the rate of useful computation, but it also requires extra circuitry to implement the error-correction functionality.

For example, as shown in FIG. 3, the noise in a digital (Boolean) circuit is so bad that the result from a single Boolean logic circuit 300 cannot be trusted as being correct. One could add second and third copies 301-302 of this same circuit 300 and take a vote of the results from the three circuits. If two circuits agreed in their result, then that would be the answer used. An error-correction decoder circuit 303 essentially takes a vote of the results from the three circuits Boolean circuits 300-302. If the results from two of the circuits agreed, that result is used as the final output. In any case, error correction by any conventional means requires additional logic circuits and processing. This increases cost and processing time.

More complex techniques use recursive redundancy, block codes, or Reed-Solomon codes, or other kinds of more sophisticated codes. All of those techniques are essentially nothing more than complicated ways to structure redundant logic, and eventually "count votes." The additional overhead for applying error-correction codes to digital computing circuits has meant that those techniques tend only to be used in mission critical circuits, where the additional expenditure of area and power is necessary.

U.S. Pat. No. 7,006,267 "Techniques for high fidelity quantum teleportation and computing" issued to Franson, et al. on Feb. 28, 2006 describes a method for using ancilla photons to assure high fidelity quantum teleportation. Ancilla photons are used to provide extra discrete states that function analogous to that of parity bits in error-correction codes. The additional states carry redundant information so that errors can be corrected, Quantum error correction is known in the art, see for example, Seth Lloyd and Jean-Jacques Slotine, "Analog Quantum Error Correction," Physical Review Letters 80, 4088-4091, Issue 18, May 1998, They describe an idea for error correction on analog variables, but only for quantum-mechanical analog variables, that are quantum entangled. The mathematics of quantum mechanics are quite different from that of classical physical systems. The idea for quantum analog error correction described requires quantum entanglement and quantum measurement to be available in order to be implemented. They state clearly that their idea may only be a theoretical curiosity and they do not propose a practical system for implementing the idea. Furthermore their idea requires quantum an cilia bits, which are essentially discrete parity bits for a quantum system.

U.S. Pat. No. 7,131,054, "Apparatus and method for efficient decoder normalization" issued to Greenberg et al. on Oct. 31, 2006 describes an apparatus and method "for normalizing a set of state metric values stored in a set of accumulators," They describe a method for performing normalization comprising: if a specified normalization condition is met, subtracting a normalization amount from a branch metric value. That system uses an "accumulator in each . . . unit [which] has a fixed precision. Therefore, all accumulators are normalized periodically to prevent overflow. They describe a method for performing normalization only when a "specified normalization condition is met." The normalization condition occurs when the accumulators are close to overflow.

Avoiding overflow is a completely different goal than reducing errors. The use of the term normalization is misleading, because they use normalization to mean reducing the magnitude of a variable.

When processing according to probability distributions, it is frequently necessary to perform normalization in order to assure that intermediate or final probability distributions are obey the rules for a properly defined probability distribution, namely that the total chance that all possible events occur cannot exceed 100%. This normalization is necessary even if the system has perfectly error-free computing hardware.

The Future

It is desired to provide an analog circuit that is a substantially error free.

SUMMARY OF THE INVENTION

A method and apparatus processes signals in a set of circuit components of an analog circuit while enforcing a set of explicit constraints corresponding to a set of implicit constraints to reduce errors in output signals.

In contrast to the prior art error correction, the invention performs error reduction. The error reduction techniques according to the embodiments of the invention are very different from convention error correcting codes because the techniques work on analog mined variables and can therefore be implemented in analog circuits, whereas all known error-correcting codes only work on discrete states. The method according to the invention can be applied to analog circuits performing a wide range of processing tasks, including but not limited to soft error-correction decoding.

The embodiments of the invention can be applied to MOSFETs operating in any mode, cut-off or below-threshold mode, triode or linear mode, and saturation or above-threshold mode, not just in sub-threshold as in the prior art, as well to any other kind of transistor such as BJTs, JFETs, and HEMTs. The invention can also be worked with analog circuits based on molectronics, spintronics, quantum dots, carbon nanostructures, biological structures, as known in the art.

It is a goal of the invention to substantially reduce errors in the processing caused by noise, uncontrollable variations in fabrication processes, systematic or non-systematic faults, parasitic effects, defects, component mismatch, offsets, current leakage, non-linearities, and sometimes hard to control environmental conditions. This makes it difficult to use analog circuits in the mass production of large complex systems, as demanded for modern electronic devices, or other sources of error from the analog circuits themselves, or from any other source, and even to enable asymptotically error-free processing using analog circuits.

DETAILED DESCRIPTION OF THE DRAWINGS

Apparatus and Method Overview

Figure 1A:
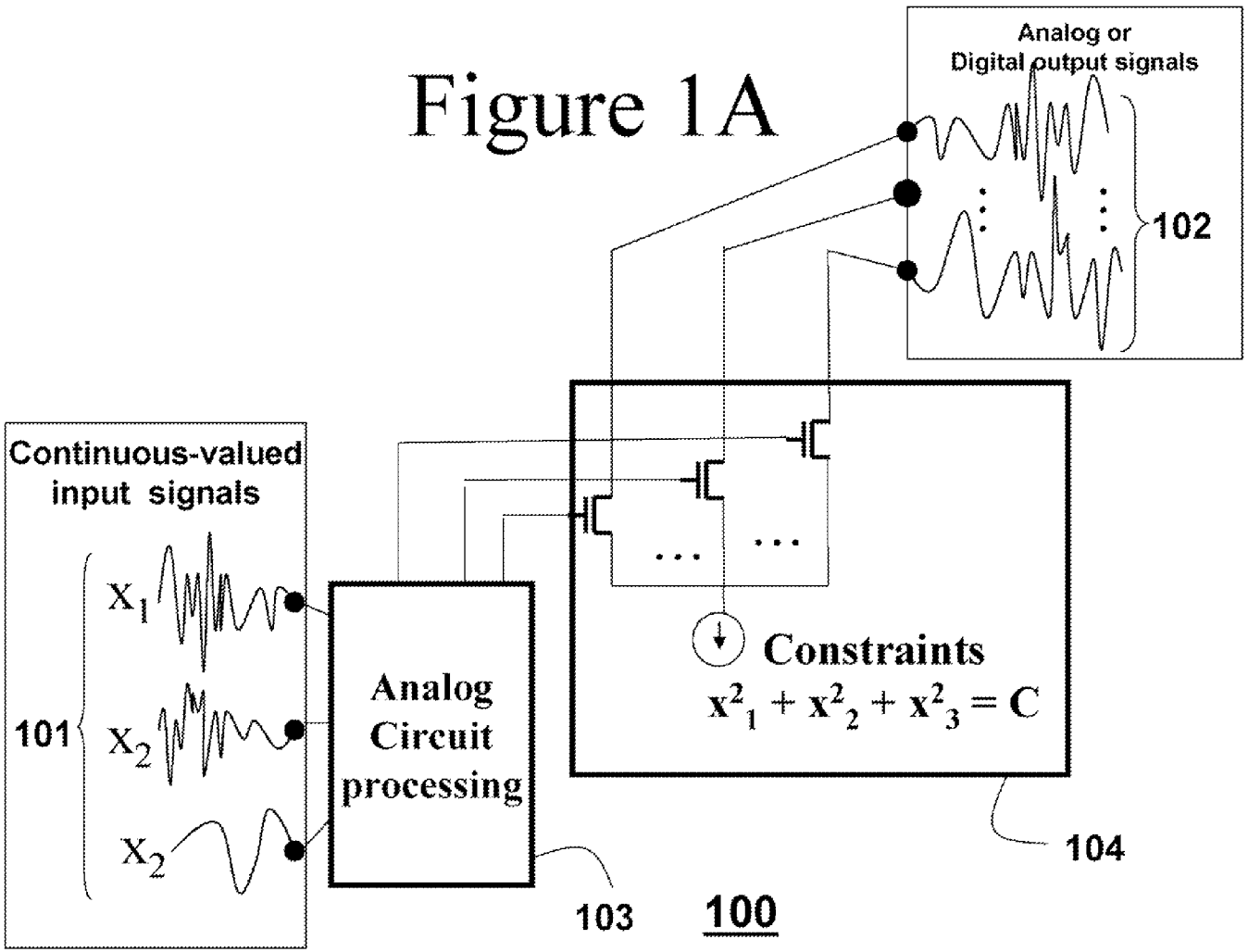
FIGS. 1A and 1B are block diagrams of an apparatus and method for reducing errors in an analog circuit according to an embodiment of the invention.
Figure 1B:
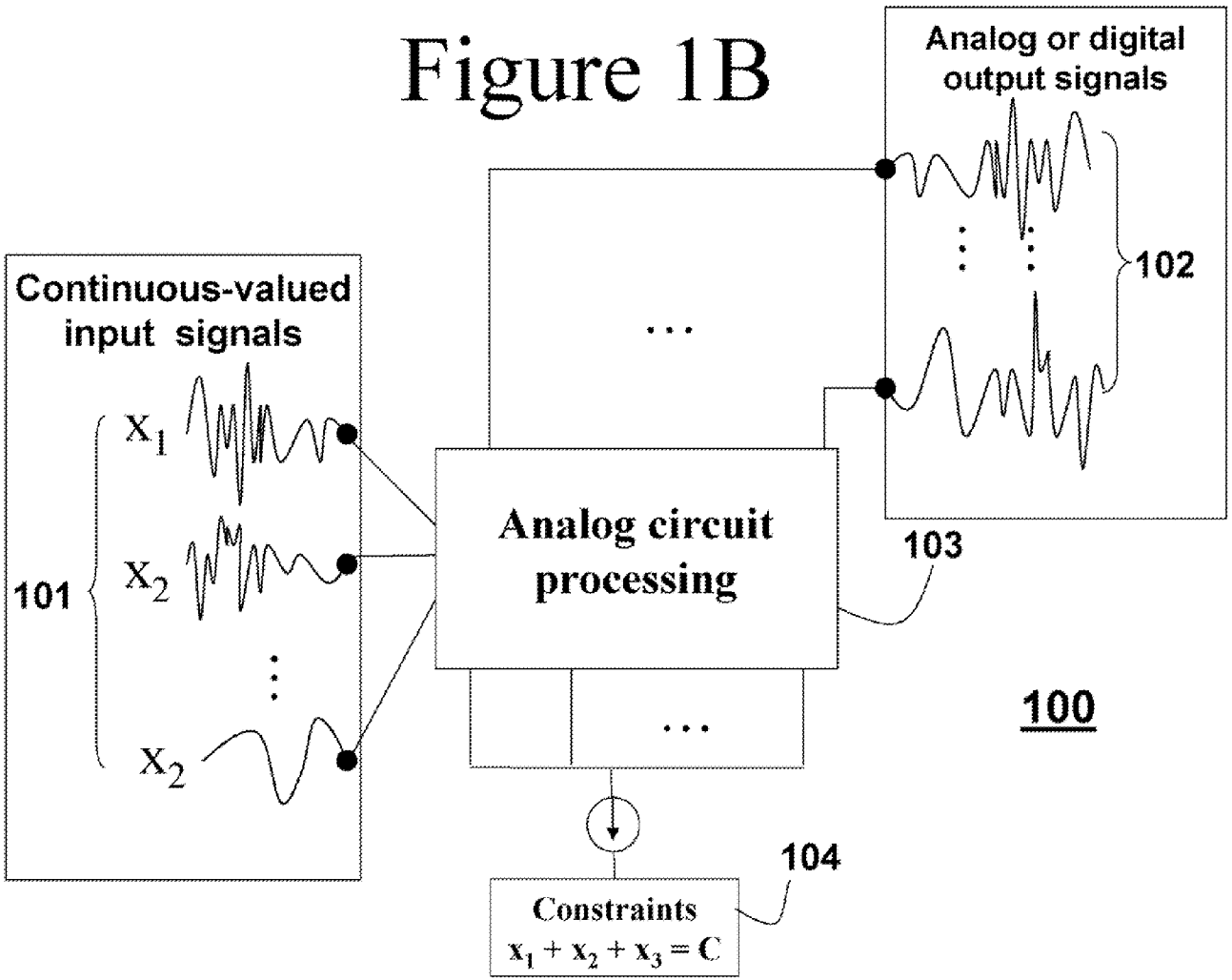
Figure 2:
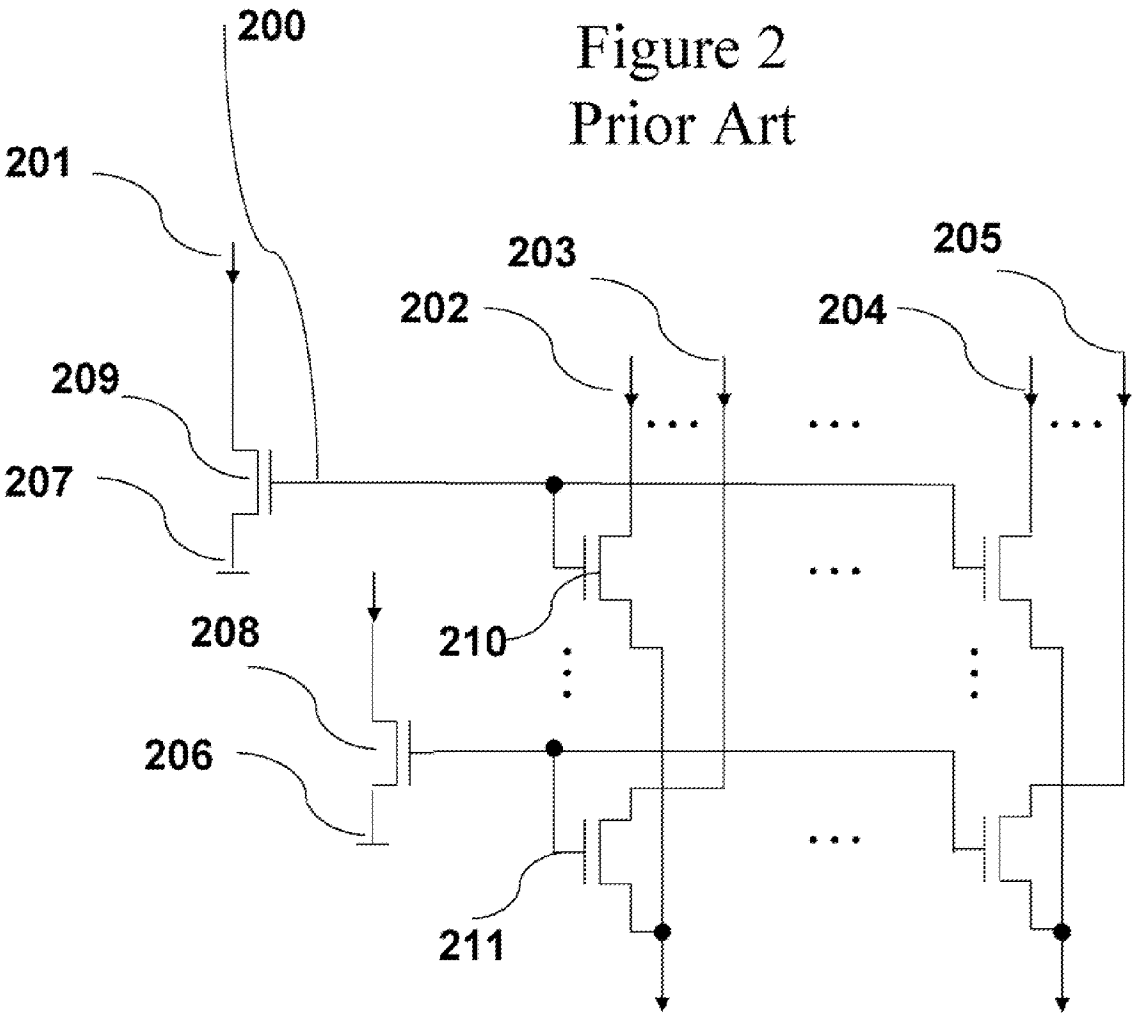
Figure 2 Prior Art
FIG. 2 is a block diagram of prior art trans-linear circuit for soft turbo decoding.
Figure 3:
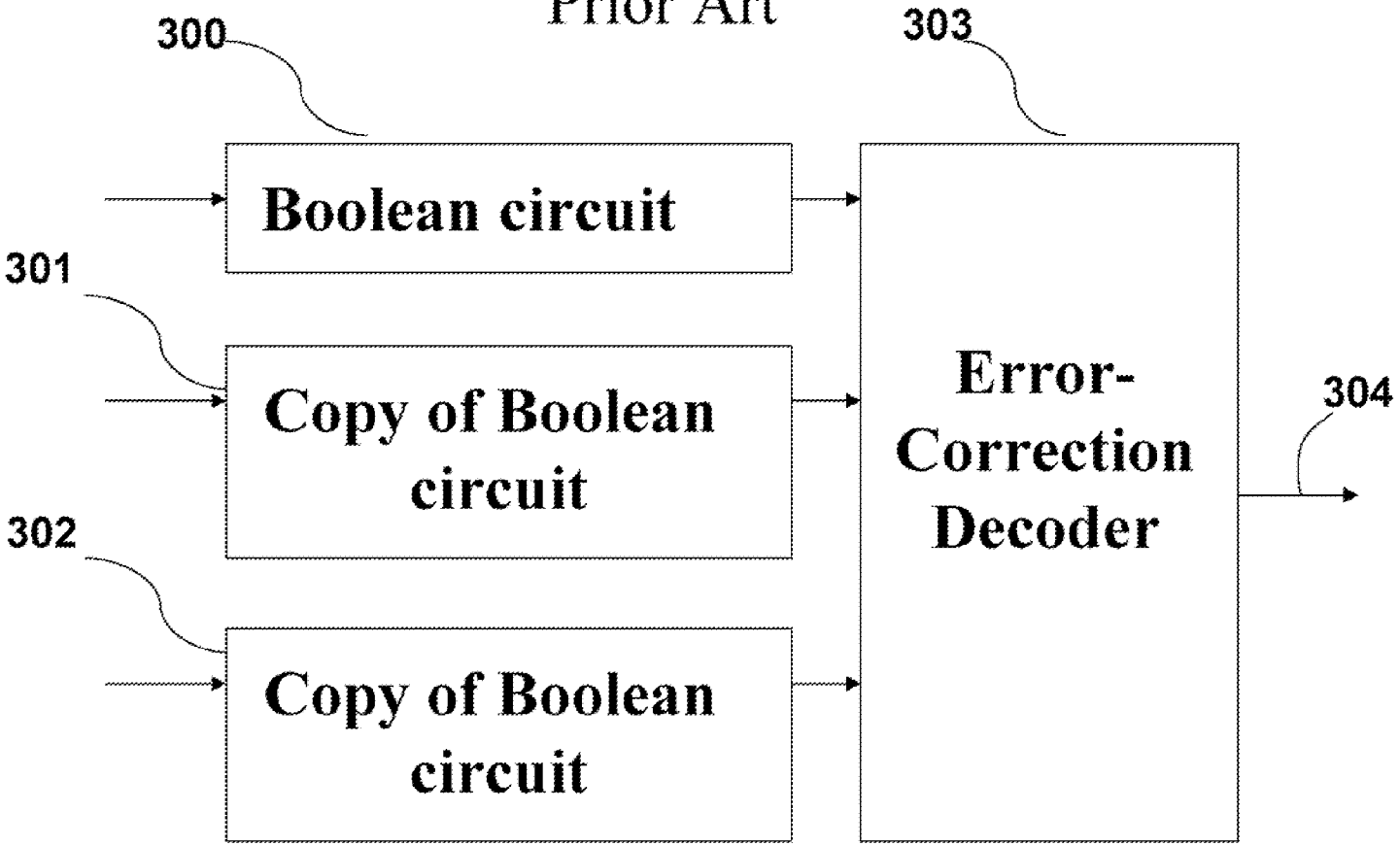
Figure 3 Prior Art
FIG. 3 is a block, diagram of a prior art error-correction method for Boolean circuits.

As shown in FIGS. 1A and 1B, the embodiments of my invention provide means 100 for reducing errors caused by an analog circuit 103 that processes analog-valued analog input signals 101 to produce analog or digital output signals 102. That is, ray output signals 102 are substantially error free.

This remarkable result is achieved by enforcing a set of analog constraints 104 while processing the analog signals. A wide variety of analog processes and constraint are described herein to illustrate the scope of my invention. FIG. 1B shows the constraints 104 being applied during the processing, instead of after the processing as in FIG. 1A.

Analog Signals

As defined and used herein, the analog input signals 101 take on a continuous range of values, either according to current, voltage, or phase. Thus, the analog signals processed by my invention can truly represent analog-valued numbers. Thus, as defined herein, when I use the term "variable," the variable can be an analog signal, or a real number or a complex number represented by the signal, a vector or matrix of real or complex numbers, or any other analog values, or a set of variables. As used herein conventionally, a set or a subset thereof can have one or more members. These analog-valued signals may be clocked discrete time signals, or smoothly varying analog-time signals.

It should be noted, that my invention can also be applied to analog charges, energies and magnetic spins, as described below.

This is in contrast with digital circuits, where the digital signals must have discrete values, e.g., ground (GND) typically represents logical 0, and some supply voltage $V_{DD}$, represents logical 1. Obviously, a digital circuit can only process an approximation of a analog-valued signal.

Processes

The processes that can be used with my invention can include linear transforms, linearized transforms, unitary transforms, statistical inference, normalized belief propagation, solving linear differential equations, solving linearized differential equations, solving linearized partial differential equations, matrix inverses, minimizing functions, or other functions that obey any conservation or scaling law.

In addition, the embodiments of my invention can reduce errors in processes where an energy or magnitude is preserved, such as in a Fourier transform (FT), wavelet transforms, fast (FFT), convolution, filtering, correlation, any unitary transform, or any function, including nonlinear functions, that can be embedded in or otherwise posed as a unitary transformation or linear transform.

To the best of my knowledge constraints for reducing errors are not used in any prior art analog computations for any of the above functions. I do not consider error reduction in finite state machines, elementary cellular automata, or digital convolutional encoders and decoders. I am not aware of any technique that can use my method of reducing errors by enforcing explicit constraints on analog circuits can be applied to inherently discrete-state systems or methods.

Constraints

Some processes have implicit constraints on what constitutes a valid state. For example, for unitary transforms, a magnitude of an input vector must be equal to a magnitude of an output vector.

The embodiments of my invention use these implicit constraints to define explicit constraints that are enforced while processing the analog signals. By analog signals, I mean the analog input signals, the analog output signals, or any intermediate analog signals, or combinations thereof, processed in the analog circuit.

When the processes are implemented using analog circuits according to embodiments of my invention, these constraints can be enforced very elegantly as part of the analog circuit operation, or by efficiently adding a small amount of additional circuitry.

One goal of my invention is to substantially reduce errors in the processing caused by noise, uncontrollable variations in fabrication processes, systematic or non-systematic faults, parasitic effects, defects, component mismatch, offsets, current leakage, non-linearities, and sometimes hard to control environmental conditions. This makes it difficult to use analog circuits in the mass production of large complex systems, as demanded for modern electronic devices, or other sources of error from the analog circuits themselves, or from any other source, and even to enable asymptotically error-free processing using analog circuits.

To help understand how enforcing explicit constraints can substantially reduce errors while processing analog signals in analog circuits, it is helpful to understand how error-correction codes can be used to reduce errors in digital circuits. Parity check constraints in the digital circuits typically involve a sum over a group of bits modulo 2.

For example, a discrete variable is expressed as two data bits $x_1$ and $x_2$, and a third parity bit $x_3$. Then, a digital error-correcting code can specify the discrete constraint $$(x_1+x_2+x_3)\mathrm{mod}_2=0,$$

where $\mathrm{mod}_2$ causes a discrete enforcement.

If noise inverts one or all three of these bits, then the constraint is no longer true, so these errors can be detected. With a sufficient number of parity bits, and more complex correction apparatus, some errors can be detected or corrected.

The embodiments of my invention use analog-valued real numbers or analog-valued complex numbers, rather than discrete or binary values. For example, if there are three analog-valued variables, an example analog constraint according to an embodiment of my invention can take the form $$x_1+x_2+x_3=C,$$

where "+" denotes conventional addition on the real numbers, and C is a constant. I call this a summation constraint. For probability distributions, the constant C=1, because probability distributions must be normalized to 100%.

It should be noted that ray summation constraint is distinguished from the normalization according to Green berg et al, distinguished above. My constraint is applied to a summation of variables and not a normalization by reducing the magnitude of a variable.

Parseval Constraint and FFT Processing

A unitary transform should not change a length of an input vector, the transform can only rotate the vector. In a FFT, the input vector and the output vector must obey Parseval's theorem. Parseval's theorem requires that the result of a Fourier transform is unitary. In other words, the sum (or integral) of the square of an input function is equal to twice the sum (or integral) of the square of its output transform:

$$\Sigma_{i=1}^{N}\mathrm{input}_{I=1}^{2}=\tfrac{1}{2}\Sigma_{i=1}^{N}\mathrm{output}_{I=1}^{2}.$$

Figure 4:
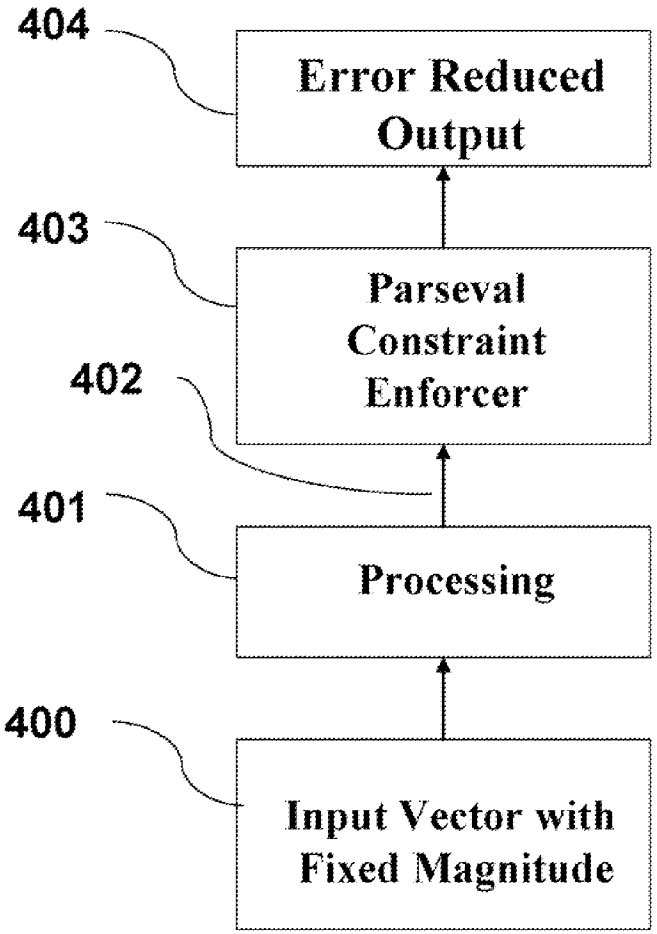
FIG. 4 is a block diagram of a method that applies the Parseval constraint to a fast Fourier transform according to an embodiment of the invention.

As shown in FIG. 4, one embodiment of my invention applies the Parseval constraint to a FFT process. An input vector 400 with a fixed magnitude undergoes some FFT processing 401. An output 402 from the processing 401 is forced by the Parseval constraint enforcer 403 to have the same magnitude as the input vector 400. The output 404 is the result of the constraint enforcer 403. Any transform that obeys Parseval's theorem can be implemented this way. My method can be applied to any size Fourier transform processor, and can also be applied to any sub-unit of a Fast Fourier Transform (FFT).

Parseval Constraint and FFT Butterfly

Figure 19:
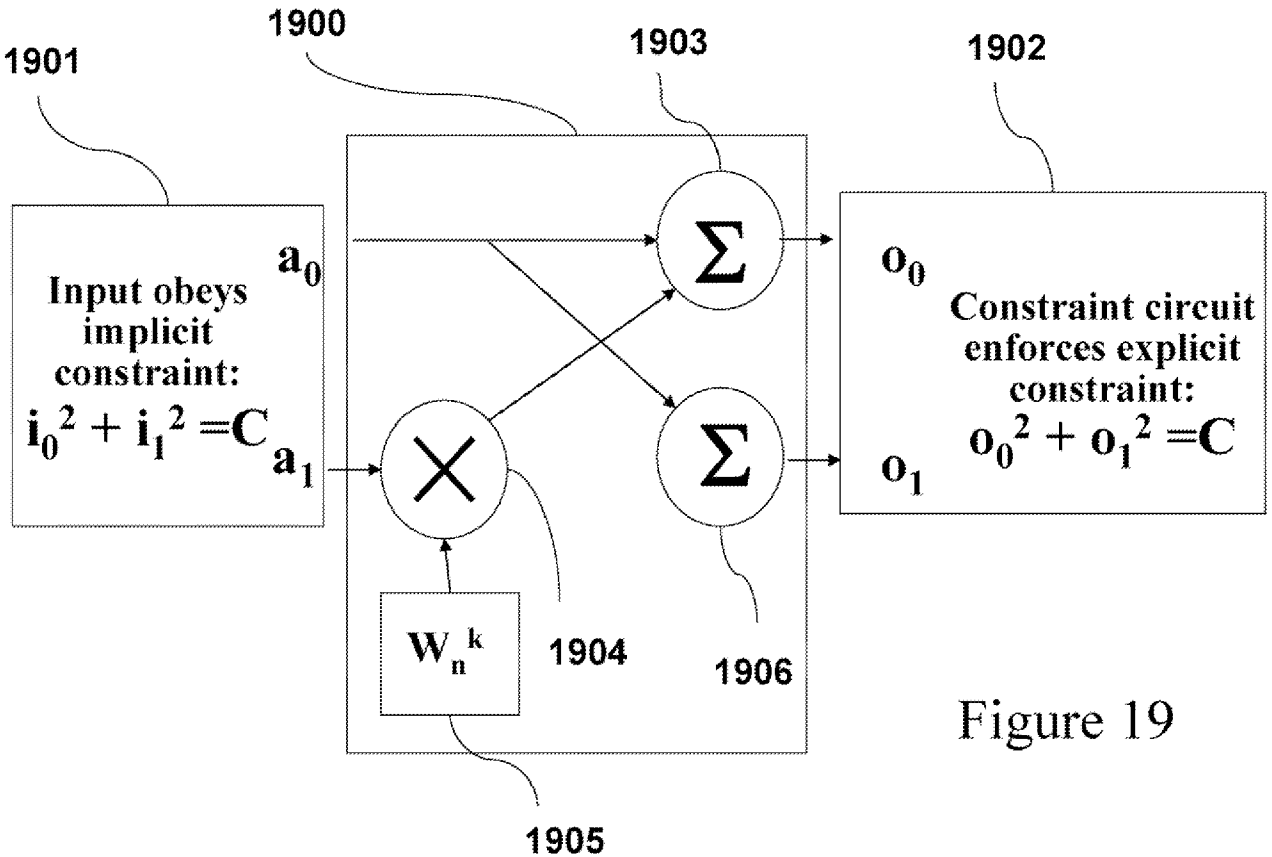
FIG. 19 is a block diagram of a method for enforcing constrains according to Parseval's law according to an embodiment of the invention.

To provide error reduction, an output vector can be forced to have the same complex magnitude as the input vector as shown in FIG. 19. This is called the Parseval constraint. FIG. 19 shows an FFT butterfly 1900 processing two complex inputs $a_0$ and $a_1$ 1901 to produce two complex outputs 1902.

The butterfly is the basic building block of an FFT. The butterfly requires a complex multiplication 1904, with one term of the product being a "twiddle factor" $W_n^k$ 1905, where n and k are indices in the FFT. The butterfly also requires a complex summation 1903 and a complex difference 1906. The Parseval constraint can be applied to an FFT butterfly, a set of FFT butterflies, or an entire FFT.

Figure 20:
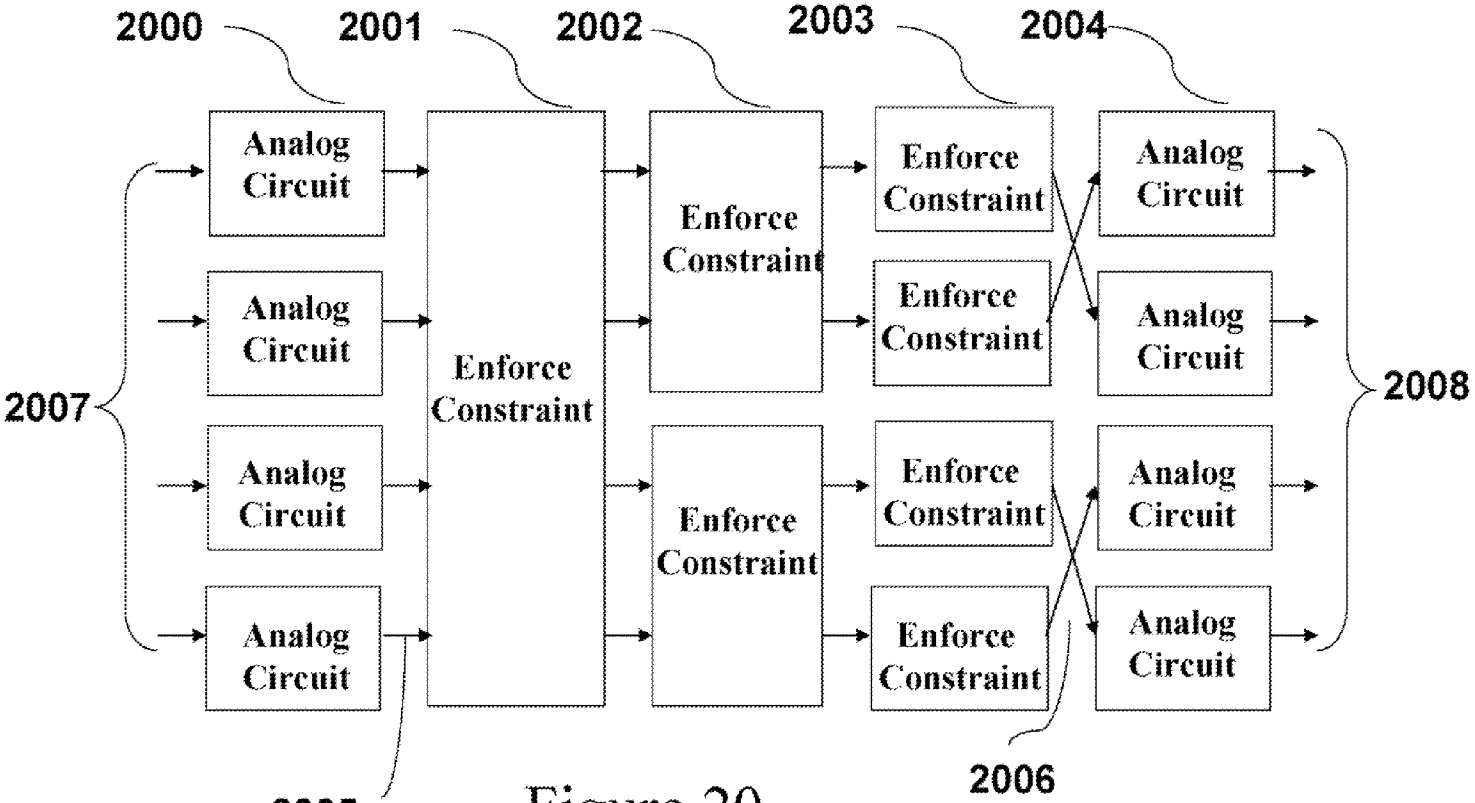
FIG. 20 is a block diagram, of a method for enforcing constrains according to Parseval's law in an analog FFT butterfly circuit according to an embodiment of the invention.

FIG. 20 shows Parseval constraints applied across various subsets of butterflies in an FFT. First each butterfly circuit 2000 processes its input 2007. Then, the Parseval constraint can be enforced collectively 2001 to all of the output variables. Then, the Parseval constraint can be enforced 2002 on large subsets. Then, the Parseval constraint can be enforced 2003 on small subsets of the output variables. Then, these error reduced variables are routed 2006 to the next processing circuit components 2004 as output 2008.

RF Receiver

Figure 21:
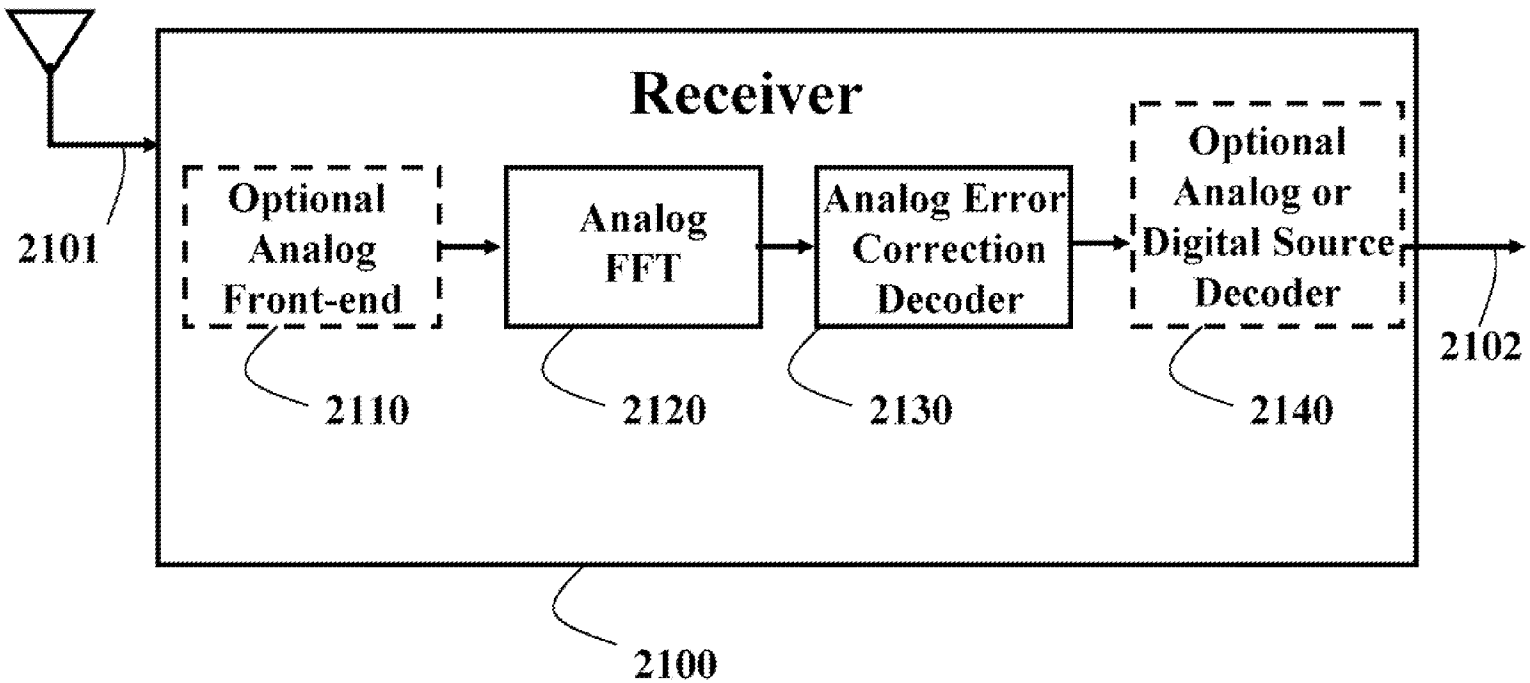
FIG. 21 is a block diagram of a receiver according to an embodiment of the invention.

FIG. 21 shows a RF receiver 2100 according to an embodiment of the invention. An analog (RF) input signal 2101 is received by an antenna and provided to an optional fron-end 2110. Next, an analog FFT operation 2120, as described, above is applied, followed by analog error correction decoder 2130 as described herein. This can be followed by an optional analog or digital source decoder 2140 to produce an analog or digital output signal 2102. It should be noted that the invention can be applied to a wide variety of receivers using any number of demodulation techniques and decoders.

Similar constraints on the input and output magnitude can be applied to any unitary transform, such as unitary matrix multiplication, filtering, convolution, correlation, FFT, Fourier transform, wavelet transform, filtering, other kernel transforms or convolutions, as well as any other operator that can be embedded in a unitary transform.

By restoring a set of variables to a valid state according to the set of constraints as described herein, errors produced while processing in the analog circuit are substantially reduced. In many of the embodiments of my invention, the apparatus or method for enforcing the constraints to reduce errors requires much less overhead than conventional digital circuits with digital error correction. Furthermore, the invention exploits analog-valued resources, which of course is impossible with conventional digital circuits.

Figure 5:
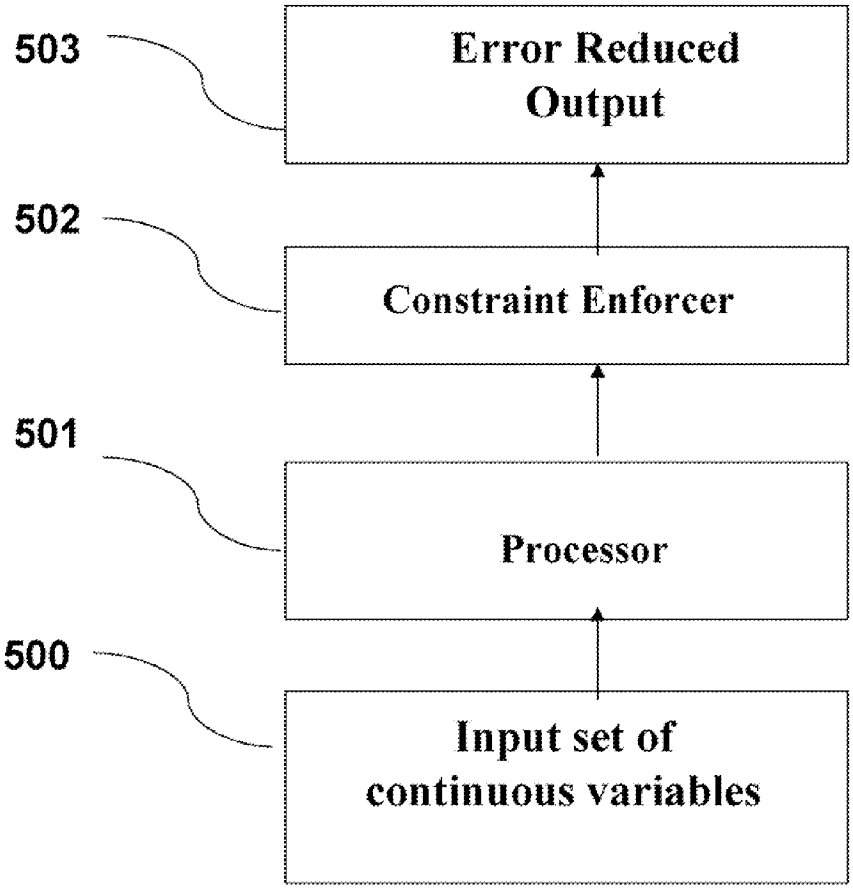
FIG. 5 is a block diagram of a method for enforcing constraints on a set of variables after processing according to an embodiment of the invention.

In general, my constraints can be applied to a set of variable as shown in FIG. 5. An input set of analog variables 500 is processed 501. A constraint enforcer 502 enforces a summation constraint, or some other constraint on the output variables from the processor 501 to produce an error reduced output 503 due to the enforced constraints.

Figure 6:
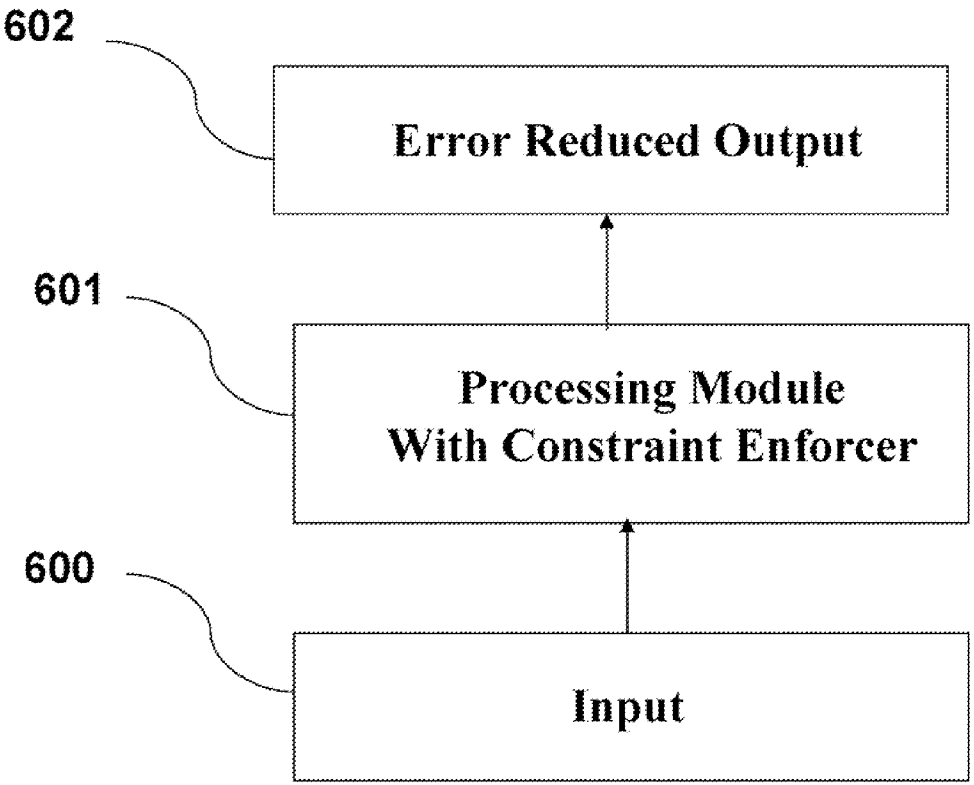
FIG. 6 is a block diagram of a method for enforcing constraints as part of processing according to an embodiment of the invention.

As shown in FIG. 6, constraints can be enforced on the variables as part of the processing rather than as a post-processing step as is shown in FIG. 5. The input 600 is supplied to a processing module and constraint enforcer 601, in which the input is both processed as constraints are enforced. This results in the error reduced output 602.

By restoring a set of variables to a valid state according to the constraint as described herein, errors are reduced, just as they are in conventional digital circuit. However, as stated above, analog processing has a number of advantages over conventional digital processing.

In this embodiment of my invention, the apparatus for enforcing the constraints to reduce errors requires much less overhead than conventional digital circuits that detect and correct errors. Furthermore, this embodiment exploits analog-valued resources, unlike conventional digital circuits operating only on discrete resources.

The embodiments of my invention can apply to MOSFETs operating in any mode, cut-off or below-threshold mode, triode or linear mode, and saturation or above-threshold mode, not just in sub-threshold as in the prior art, as well to any other kind of transistor such as BJTs, JFETs, and HEMTs in any of the above modes. The invention can also be worked with analog circuits based on molectronics, spintronics, quantum dots, carbon nanostructures, biological structures, as known in the art.

For example, if voltage $V_1$ represents variable $x_1$, and $V_2$ represents $x_2$, and so forth, then by charging adjacent capacitive components with these voltages another adjacent capacitive component will assume an average of the voltages. This embodiment could apply for example to quantum dots, or quantum dot cellular automata, see FIG. 18.

Voltage Constraints

If voltages $V_1$ through $V_N$ are connected to a single electrical node then these voltages must all be equal. In this embodiment Kirchhoff's voltage law (KVL), described in further detail below, enforces the equality constraint over the real variables.

Current Constraints

In another embodiment, charges $C_1$ through $C_N$ represent variables $x_1$ through $x_N$ respectively, and the constraint $C_1+C_2+\ldots+C_N=C_0$ is enforced by limiting the total amount of charge $C_0$ that is available to the circuit. This kind of embodiment applies to adiabatic computing circuits for example.

Spin Constraints

In another embodiment, spins $S_1$ through $S_1$ represent variables $x_1$ through $x_N$ respectively, and $E(S_1)$ represents the energy of a given spin state relative to its magnetic environment. The constraint $E(S_1)+E(S_2)+\ldots+E(S_N)=E_0$ is enforced by limiting the total amount of energy that is available to the circuit. This kind of embodiment applies to computing with spintronics. This method of applying the law of conservation of energy to enforce error reducing constraints on analog variables can be applied to any application where a conserved energy or other conserved quantity is defined for every analog state.

Kirchhoff Law Constraints

Constraints based on the associative rule can be applied by applying a summation constraint using Kirchhoff s voltage law (KVL) or Kirchhoff's current law (KCL), on an ordering the subsets of analog states each time the constraint is applied, and then converting the current to voltage and using KVL to enforce equality. For example one current sum using KCL determines $(I_1+I_2)+I_3=C*V_A$ where C is an arbitrary constant. Another constraint determines $I_1+(I_2+I_3)=C*V_B$. Then, the constraint $V_A=V_B$ is enforced by KVL. Alternatively, the equality between two currents can be enforced by a current mirror, as known in the art. A current mirror is an adjustable current regulator that "copies" a current flowing through one device by controlling the current in another device. This constraints the output current to be constant regardless of the load. The current being "copied" can vary.

In another embodiment, ancilla variables are employed. Ancilla variables are variables that act as parity bits in an error correcting code. They do not carry actual data, but are present to act as a reservoir for entropy, e.g., noise, errors, etc. In one embodiment using ancilla variables, constraints are enforced over both some sets of variables and ancilla variables, and the ancilla variables are initialized at a known value. Subsequently, an external system continues to maintain the ancilla variables at a known value as they participate in the constraints on the set of variables. Ancilla variables as used here are not discrete quantum ancilla variables, but analog valued "parity" states.

Constraints and Analog Variables

I describe a wide variety of ways that constraints can be enforces according to the embodiments of my invention. In FIGS. 7-13, the small dots represent a set of analog variables processed according to the embodiments of my invention.

Figure 7:
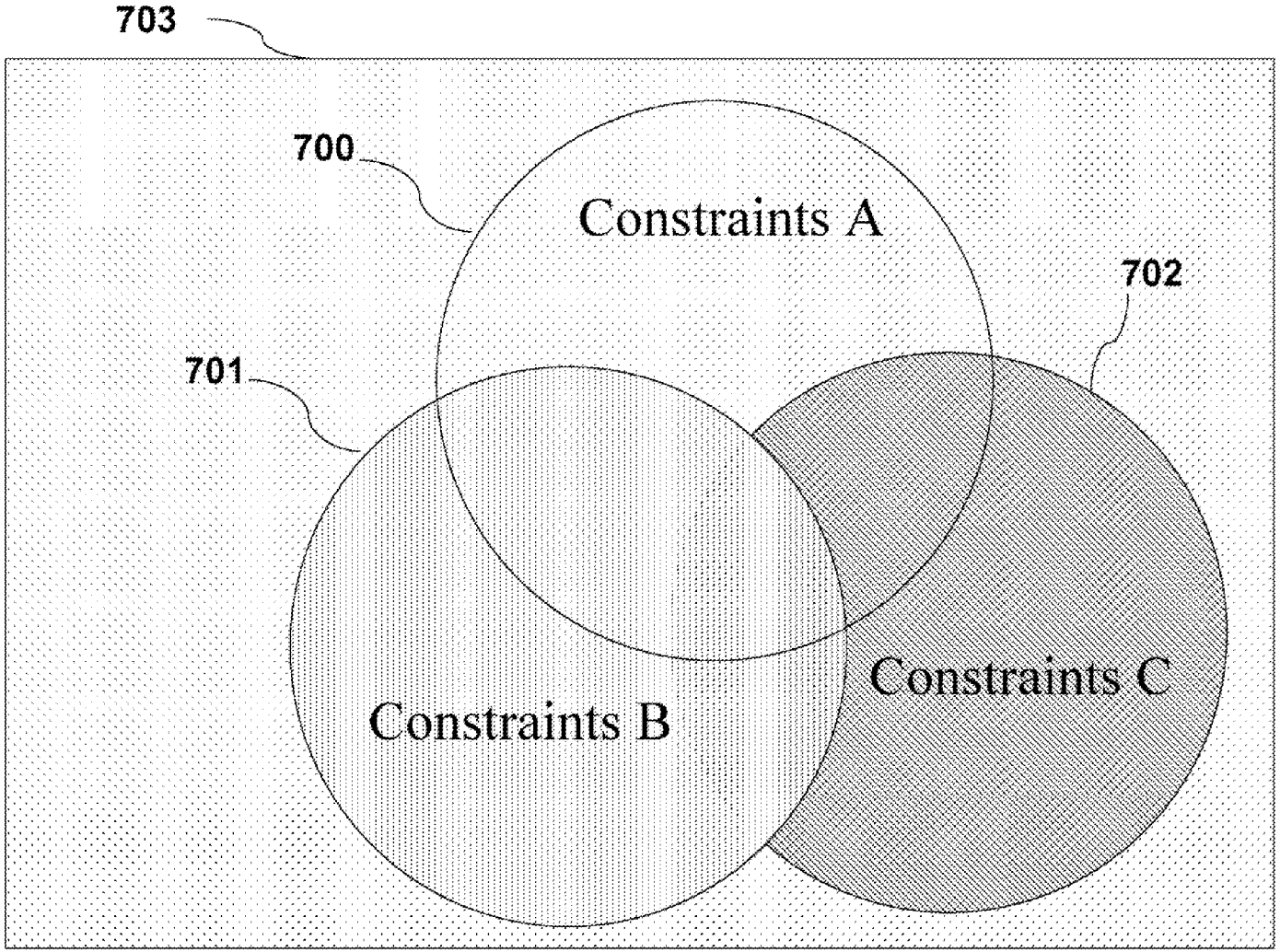
FIG. 7 is a block, diagram of a method for enforcing constraints on overlapping subsets of variables according to an embodiment of the invention.

As shown in FIG. 7, different constraints can be enforced on overlapping subsets of the variables 683 in a processor. A set of constraints A is enforced on the subset of variables 680. A set of constraints B is enforced on the subset of variables 681. A set of constraints C is being enforced on the subset of variables 682. In this embodiment, there are variables which participate in more than one set of constraint. In general, variables can participate in more than one constraint of the same or different types.

Figure 8:
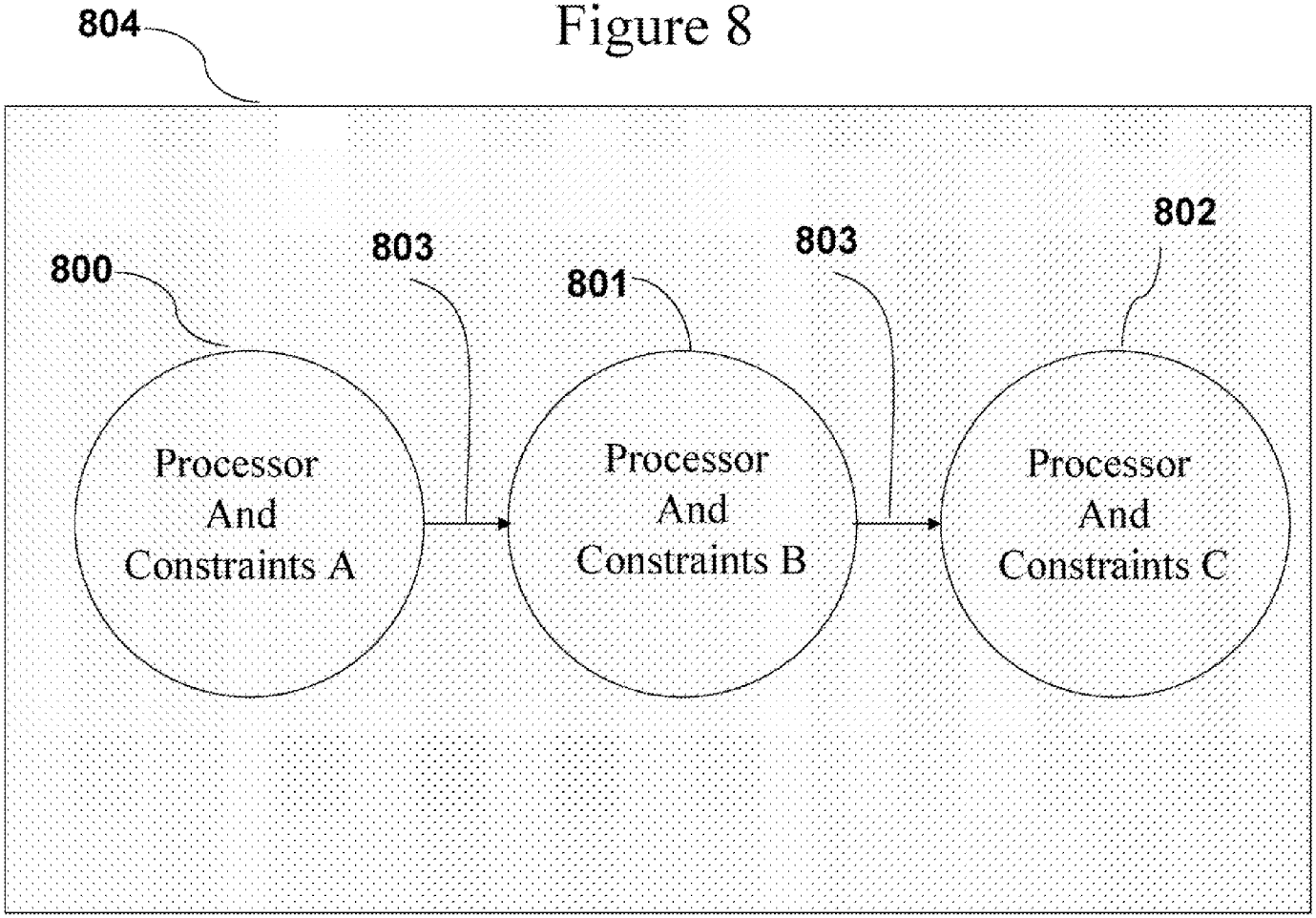
FIG. 8 is a method for enforcing constraints on successive subsets of variables according to an embodiment of the invention.

As shown in FIG. 8, different constraints can be enforced on successive subsets of the variables 804 to be processed. A set of constraints A is enforced on a first subset of variables 800. Then, then the result from this processing, a subset of variables 801, is sent 803 to a successor processor where a set of constraints B is enforced on. Then, the result of this processing is further processed under a set of constraints C for a subset of variables in 802.

Figure 9:
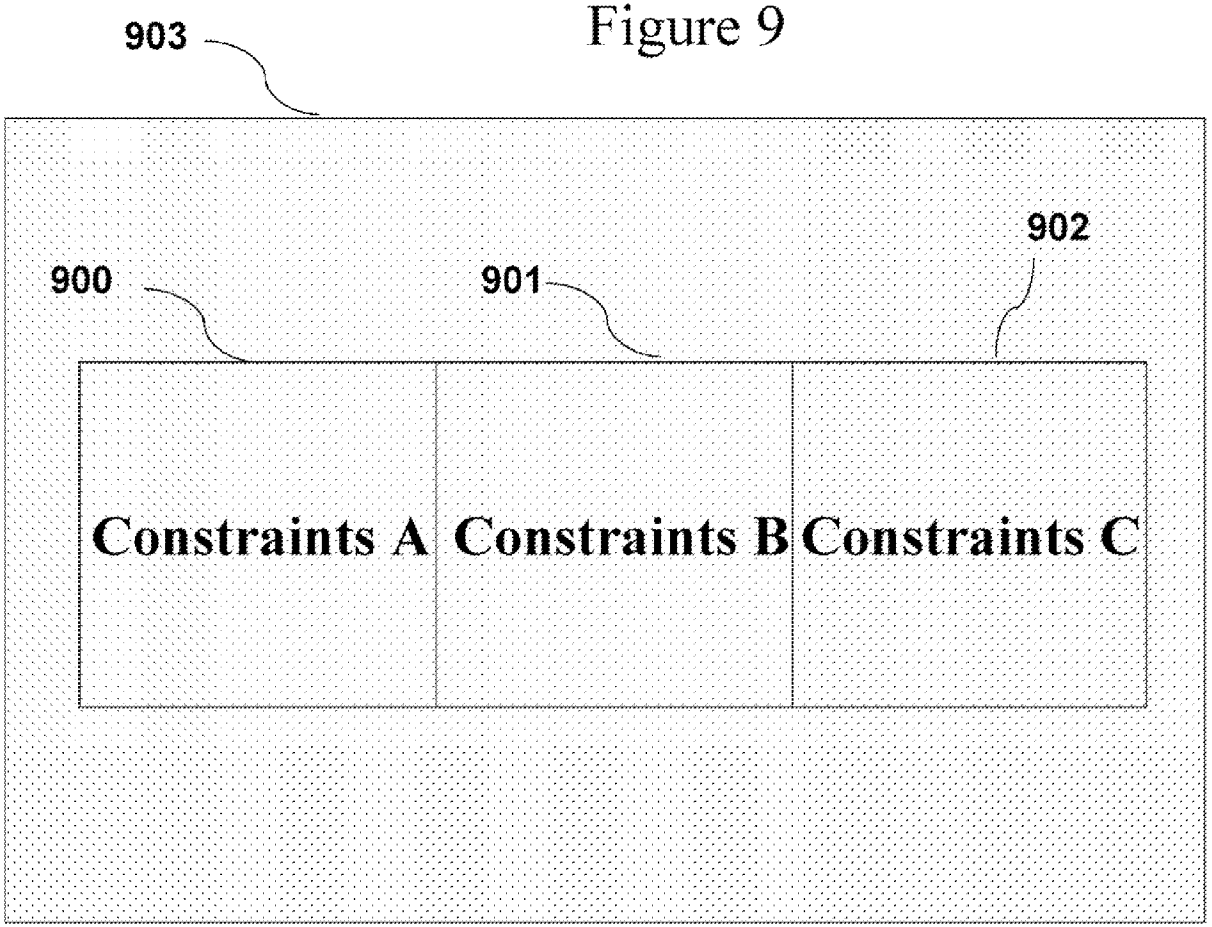
FIG. 9 is a block diagram of a method for enforcing constraints on spatially adjacent subsets of variables according to an embodiment of the invention.

As shown in FIG. 9, different constraints can be enforced on spatially adjacent subsets of the variables 903, so that each variable participates in exactly one type of constraint. A set of constraints A is enforced on the subset of variables 900. A set of constraints B is enforced on the subset of variables 901. A set of constraints C is enforced on the subset of variables 902.

Figure 10:
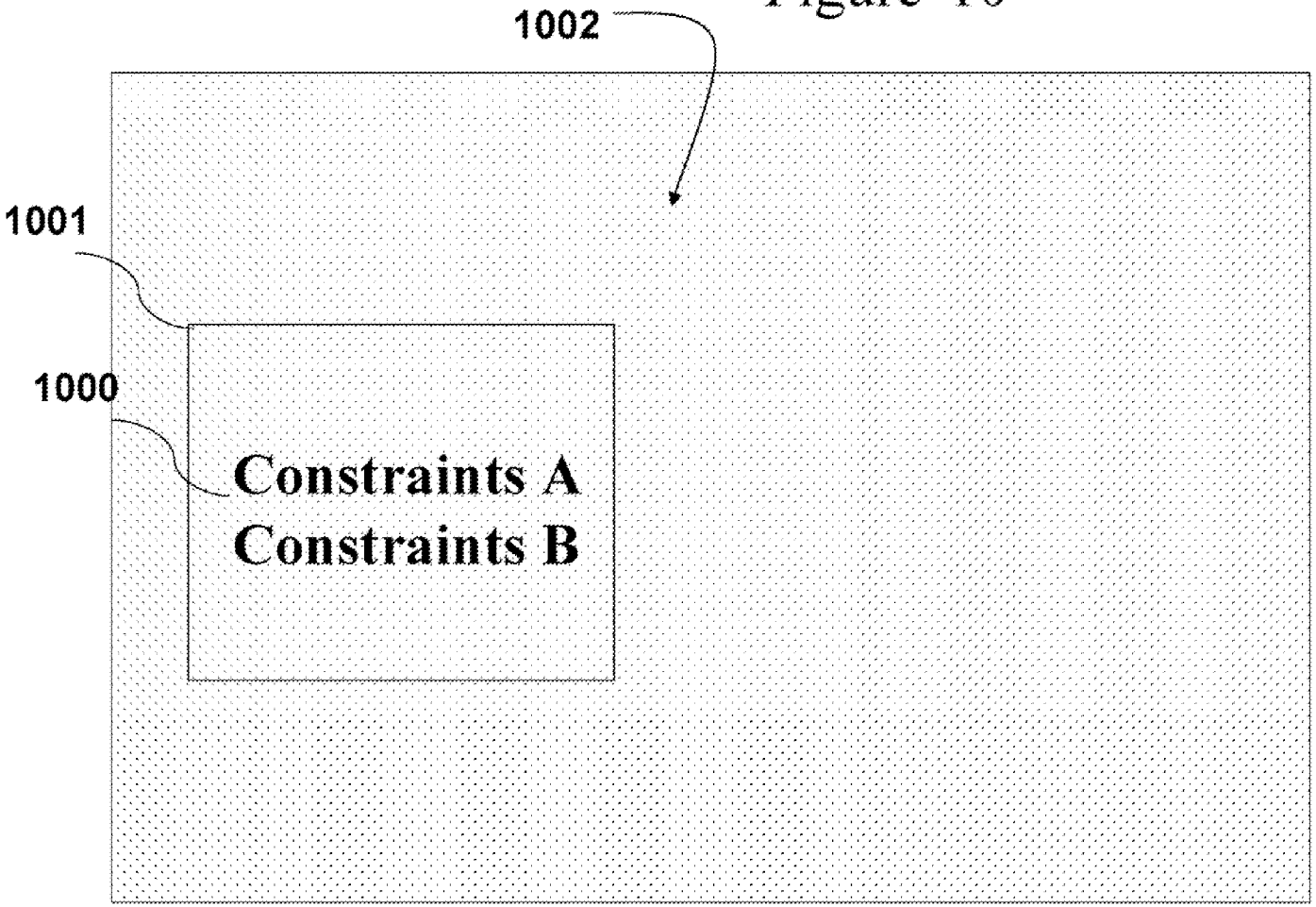
FIG. 10 is a block diagram of a method for imposing a set of constraints on the same subset of variables according to an embodiment of the invention.

As shown in FIG. 10, multiple different constraints 1000 can be enforced on the same subset 1001 of the set of variables 1002 being processed. Constraints A and B can be enforced on the same subsets of the variables being processed.

Figure 11:
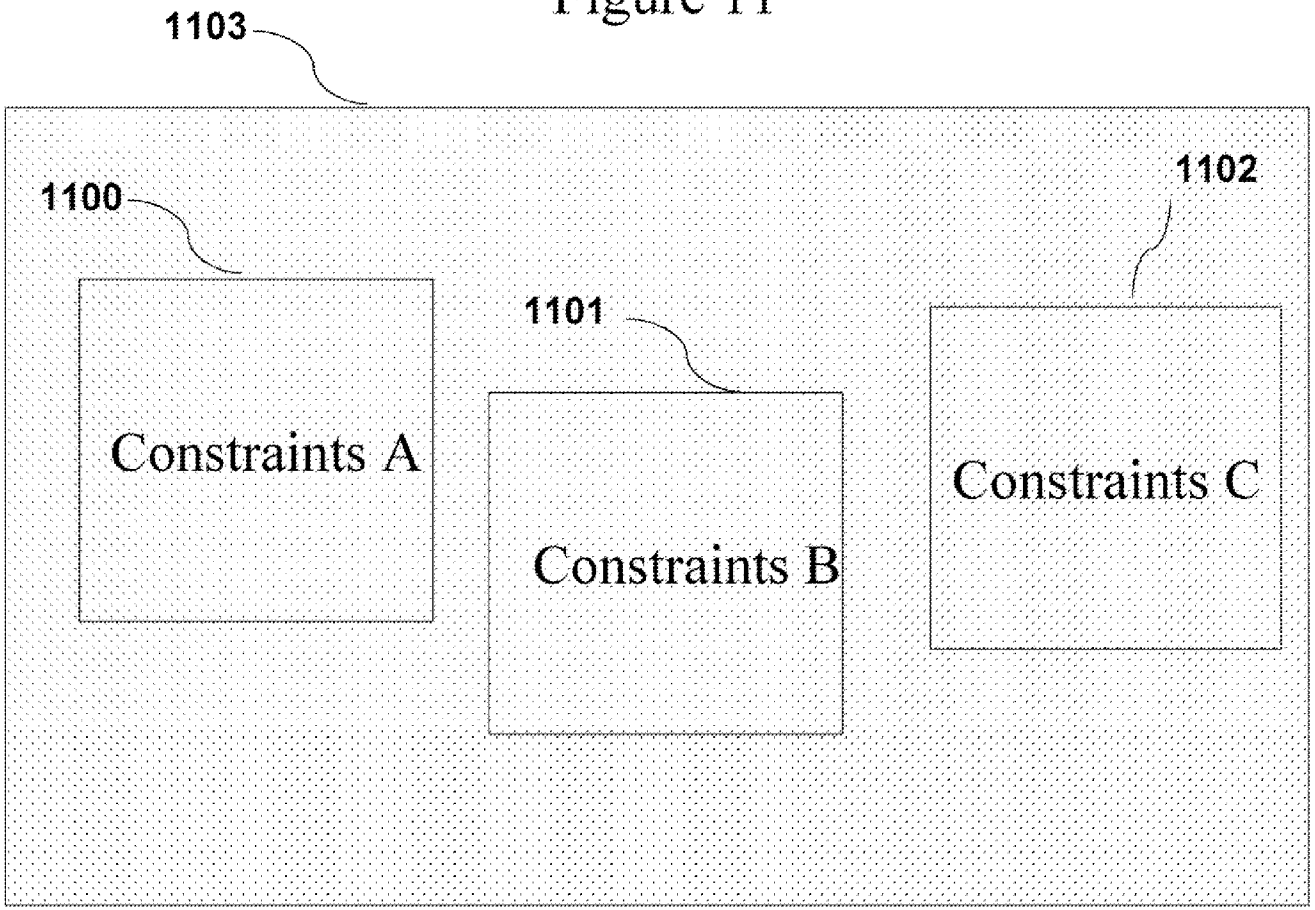
FIG. 11 is a block diagram of a method for imposing different sets of constraints on different subsets of variables according to an embodiment of the invention.

As shown in FIG. 11, different sets of constraints can be enforced on different subsets of the variables 1103 in a processor. A set of constraint A is enforced on a subset of variables 1100. A set of constraints B is enforced on a subset of variables 1101. Constraints C are enforced on the subset of variables 1102.

Figure 12:
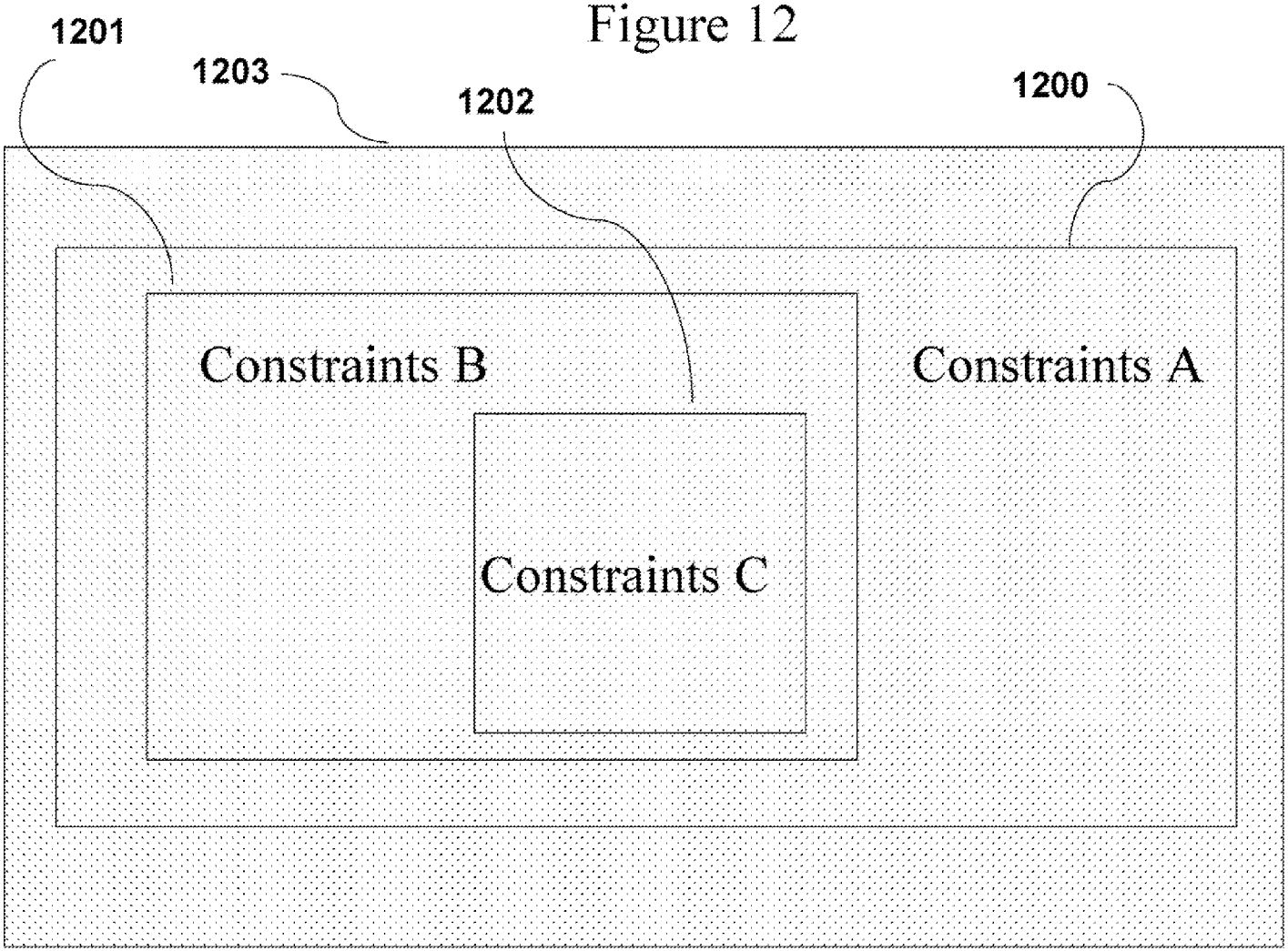
FIG. 12 is a block diagram of a method for imposing different sets of constraints on hierarchically subsets of variables according to an embodiment of the invention.

As shown in FIG. 12, different constraints can be enforced on hierarchically defined subsets of variables 1203 in a processor. A set of constraints A is enforced on the subset of variables 1200. In addition, the variables in subset 1201 must also obey constraints B, and the variables in subset 1202 must also obey the set of constraints C.

Figure 13:
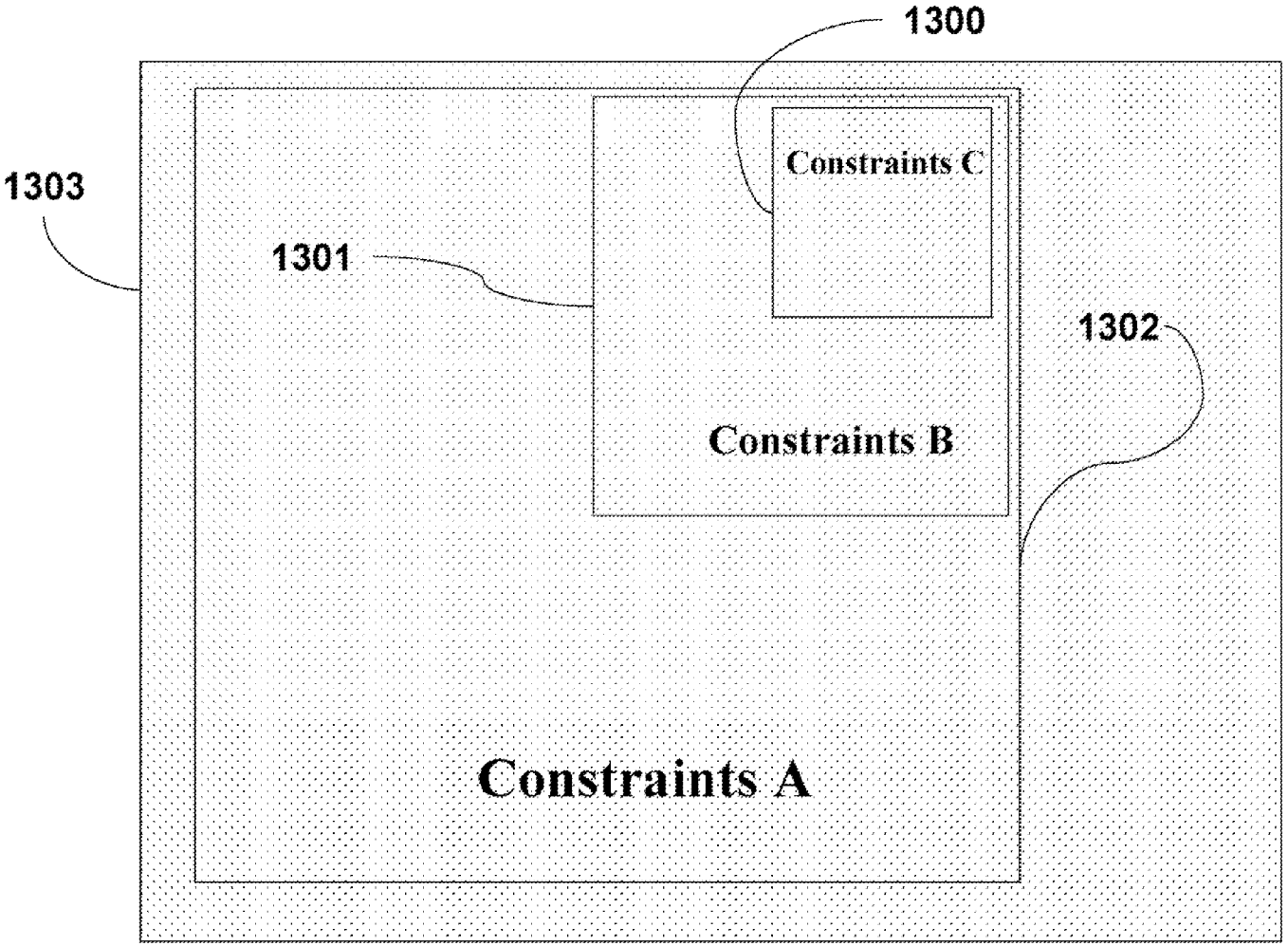
FIG. 13 is a block diagram of a method for imposing different kinds of constraints on recursively defined subsets of the variables according to an embodiment of the invention.

As shown in FIG. 13, different constraints A, B and C 1300-1302 can be enforced on recursively defined subsets of variables 1303. In the recursively defined subsets, every variable participates in every kind of constraint, but a given constraint of a given kind is not enforced on all the variables, but only a subset of the variables. Furthermore, each variable participates in a constraint with some set or subset of other variables.

Discrete States

Figure 14:
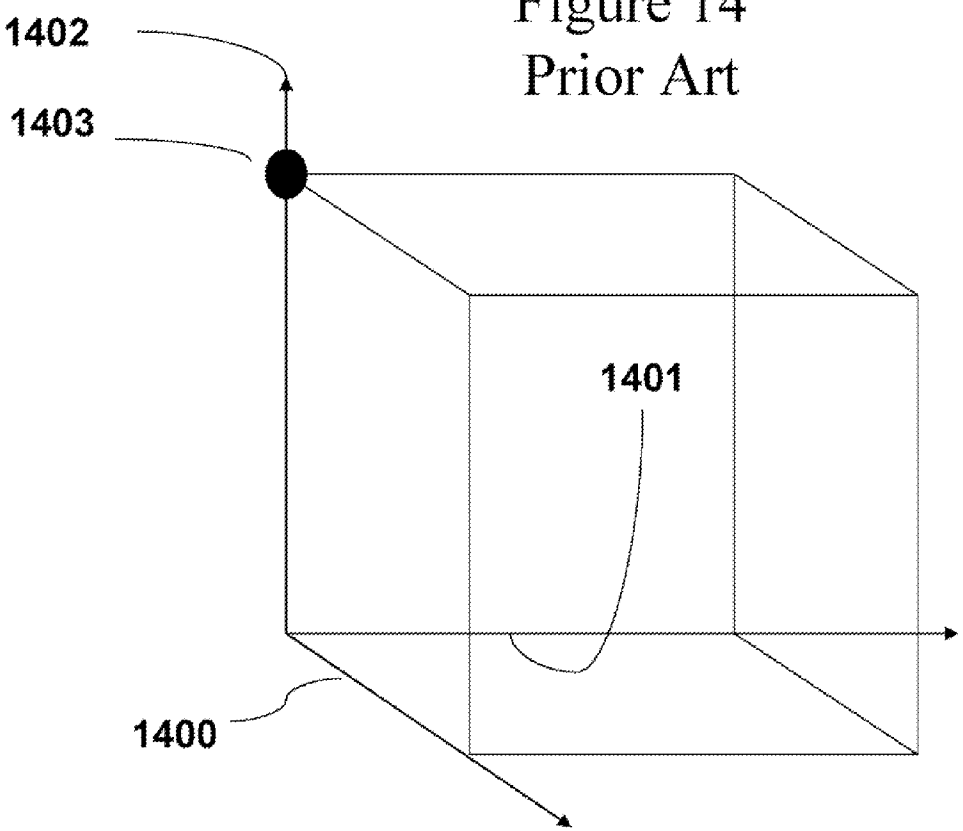
Figure 14 Prior Art
FIG. 14 is a prior art 3-dimensional hyper-cube that represents a conventional three-degree-of-freedom (register/transistor/device) digital computer

FIG. 14 shows a three-dimensional hyper-cube that represents a three-degree-of-freedom (register/transistor/device) conventional digital computer. Each axis, 1400-1402 represents a degree-of-freedom in the computer. Only discrete digital states (zero or one) are valid for each, degree of freedom. Therefore, only the discrete corners 1403 of the hyper-cube constitute valid states. A digital computer essentially forces states that are not on a corner of the hyper-cube to be reset to a nearest corner. Restricting the valid regions of the state space that the computing system can occupy to discrete states corrects the effects of errors that tend to "pull" the system away from these valid states dining the course of a computation.

Analog States

Figure 15:
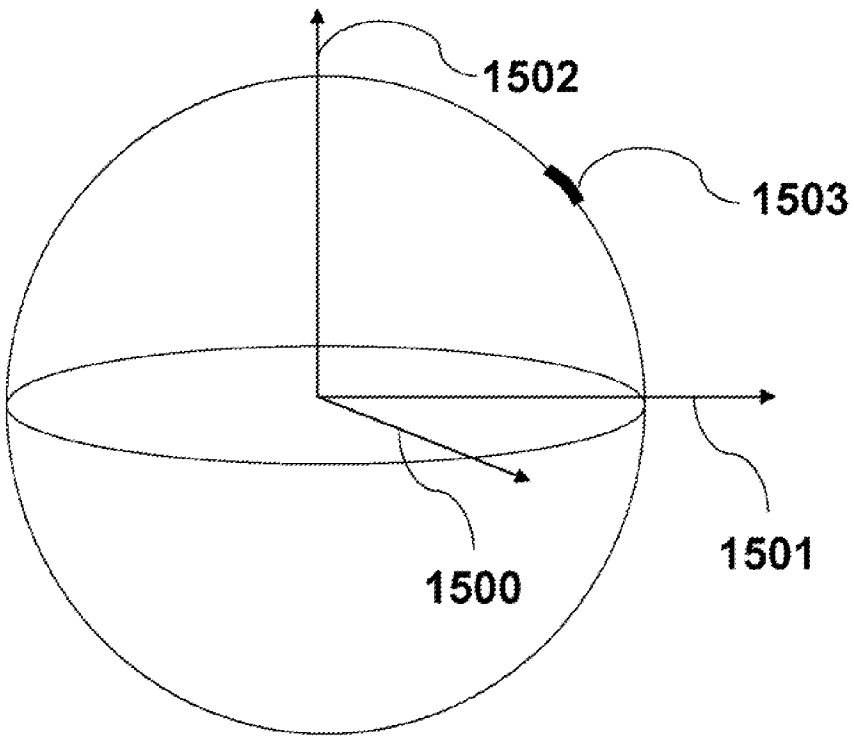
FIG. 15 is a method for forcing the sum of valid analog states to exist on the surface of a unit hyper-sphere according to an embodiment of the invention.

In FIG. 15, the axes 1500, 1501, and 1502 represent degrees-of-freedom in an analog processor according to an embodiment of the invention. From a geometric point of view, the summation constraint over the squares of variables, with C=1, forces the sum of valid states to exist on the analog surface of a unit hyper-sphere as is shown for the analog state 1503. Other constraints, such as the summation constraint over variables, can place bounds for valid states to lie on or below any analog manifolds, families of manifolds, analog geometric surfaces, or families of geometric surfaces, cf. FIG. 14.

Figure 16:
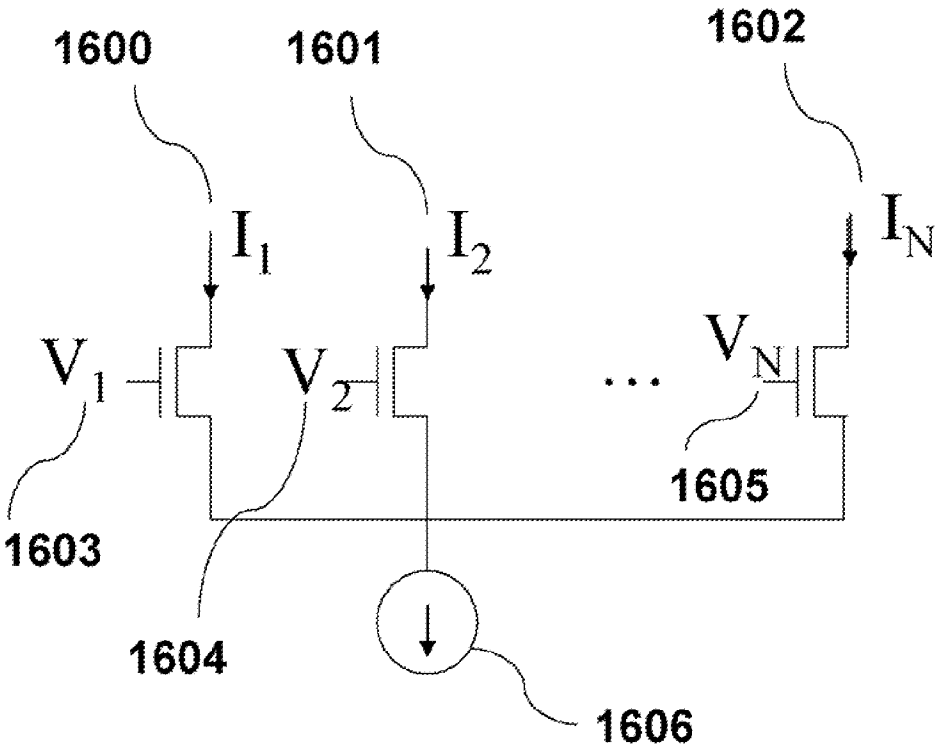
FIG. 16 is a circuit diagram of current summation constraints with transistors according to an embodiment of the invention.

FIG. 16 shows how enforce a constraint on a sum of squares of real variables, where each variable is initially represented by a voltage. If voltage $V_1$ 1603 represents variable $x_1$, and voltage $V_2$ 1604 represents $x_2$, and so forth to $V_N$ 1605, then the MOSFETs operating in above-threshold mode generate currents $I_1$ 1600, $I_2$ 1601, through $I_N$ 1602 proportional to the square of the corresponding voltages. The current supply 1606 enforcing the sum of the squares of the variables to be equal to a constant current.

Figure 17:
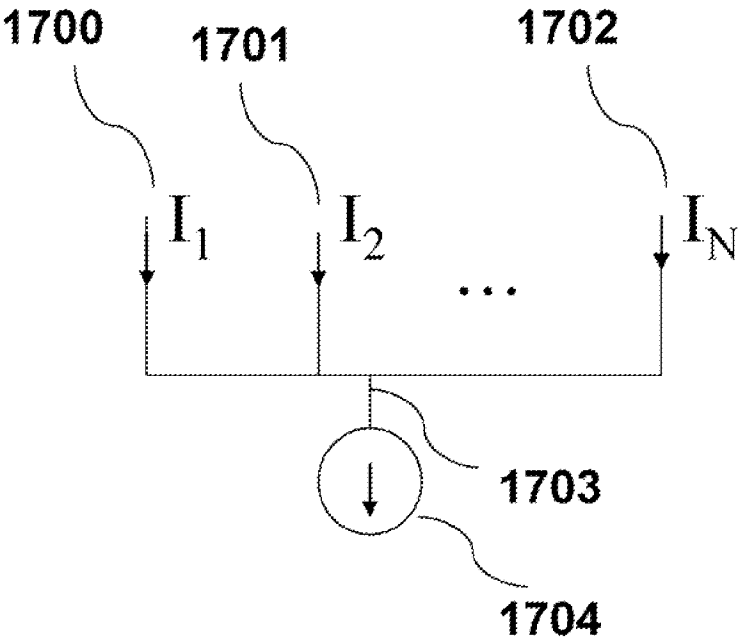
FIG. 17 is a circuit diagram of a current summation constraint enforced by Kirkoff's law according to an embodiment of the invention.

In one embodiment of the invention as shown in FIG. 17, the summation constraint is enforced by using Kirkoff's Current Law (KCL). As shown in FIG. 17, current $I_1$ 1680 represents variable $x_1$, current $I_2$ 1681 represents $x_2$, and so forth to current $I_N$ 1682. If the terminals with currents $I_1$ through $I_N$ 1682 are connected to a single node 1683 to enforce that the current through that node is equal to a given current $I_0$ by a current source 1684, then the sum of currents $I_1+I_2+\ldots+I_N=I_0$. In this embodiment, KCL enforces the constraint over the variables.

Figure 18:
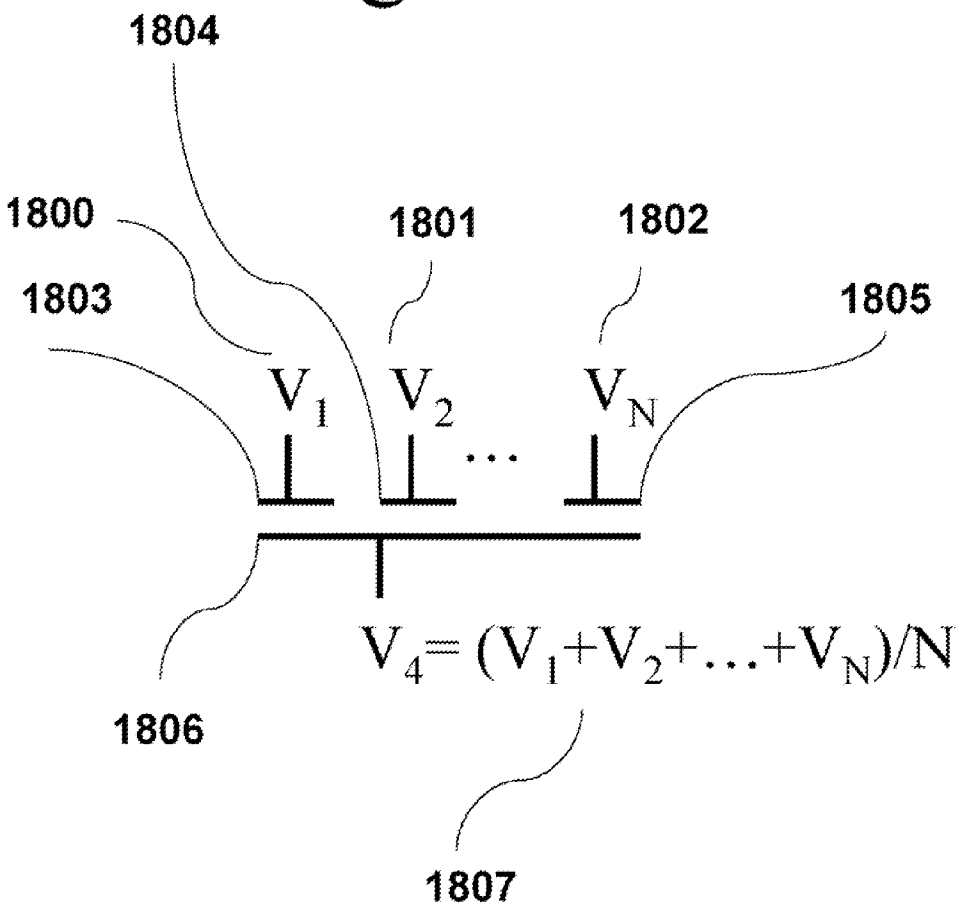
FIG. 18 is a diagram of voltage summation constraints according to an embodiment of the invention.

As shown in FIG. 18, if voltage $V_1$ 1800 represents variable $x_1$, and $V_2$ 1801 represents $V_2$, and so forth to $V_N$ 1802, then by charging adjacent capacitive components 1803, 1804, 1805 with these voltages another adjacent capacitive component 1806 assumes an average of the voltages $V_4$ 1807. This embodiment of the invention could apply, for example, to quantum dots or quantum dot cellular automata.

Glossary of Terms

The following terms are used below are defined herein as below. Any of the analog circuit components described below alone, or in various combinations can be used in embodiments of the invention.

BJT

A bipolar-junction-transistor or BJT is a transistor with a transfer-function. Terminal 1 of a BJT is called the collector. Terminal 2 of a BJT is called an emitter. Terminal 3 of a BJT is called the base. The transfer-function of the BJT can be modeled most simplistically by the equation $$I_E=I_0^{(VBE/VT)}$$

where, $I_E$ is the emitter current, $V_{BE}$ is the base-emitter voltage, and $V_T$ is the thermal voltage kT/q.

MOSFET

A metal-oxide-semiconductor field-effect transistor or MOSFET is a transistor with terminal 1 called the drain. Terminal 2 of the MOSFET is called a source, and terminal 3 is called the gate. The MOSFET has an entirely different transfer-function depending on the settings of $V_{DS}$ and $V_{GS}$.

A particular transfer-function of a MOSFET is called the operating-mode. The most important operating-modes of a MOSFET are called below-threshold-mode ($V_{GS}<V_{TH}$), linear-mode ($V_{GS}>V_{TH}$ and $V_{DS}<V_{GS}-V_{TH}$), and saturation-mode ($V_{GS}>V_{TH}$ and $V_{DS}>V_{GS}-V_{TH}$). The transfer-function of each, operating-mode is fundamentally different than the transfer-function for other operating-modes.

The transfer-function for a MOSFET in the below-threshold-mode ($V_{GS}<V_{TH}$) is similar to the transfer-function of the BJT. It is given by, $$I_{DS}=uC_{OX}(W/L)\exp(V_{GS}-V_{TH}).$$

The transfer-function for a MOSFET in linear-mode is similar to the transfer-function of the BJT. It is given by, $$I_{DS}=uC_{OX}(W/L)[(V_{GS}-V_{TH})-V_{DS}/2]V_{DS}.$$

The transfer-function for a MOSFET in saturation-mode is similar to the transfer-function of the BJT. This function is given by, $$I_{DS}=u(C_{OX}/2)(W/L)(V_{GS}-V_{TH})^2=K(T)(V_{GS}-V_{TH})^2$$

where, $I_{DS}$ is the current from the drain to the source, $V_{GS}$ is the voltage differential between the gate and source, $V_{TH}$ is the threshold voltage of the MOSFET, W is the width of the MOSFET, L is the length of the MOSFET, and $C_{OX}$ is the gate capacitance per area set by the oxide thickness Because the transfer-function and other aspects of operation of a circuit including MOSFETs and other circuit-components is determined by the transfer-functions, the design of a circuit assumes a given operating-mode for each of the MOSFETs. If the operating-mode of one or more MOSFET circuit-components in a circuit is changed, then the transfer-function of the circuit changes, and the circuit will almost always fail to produce the desired output for a given input. This require that the circuit is re-designed to achieve the desired transfer-function and operation using the new operating-mode or operating-modes.

Rearranging the transfer-function of the BJT yields $$V_{BE}=V_T\ln(I_E/I_0).$$

Rearranging the transfer-function of the MOSFET yields $$V_{GS}=\sqrt{(I_{DS}/K(T))}+V_{TH}.$$

Other field effect transistors are junction gate field-effect transistor (JFET), and high electron mobility transistor, or heterostructure (HFET).

Circuit Components

A quadratic-component is a circuit or circuit-component that performs a transfer function given at least in part by a second-order polynomial and/or a square-root function.

An exponential-component is a circuit or circuit component that performs a transfer function given at least in part by an exponential or logarithmic function.

A saturation-mode-MOSFET-circuit is a circuit that includes at least one MOSFET serving as a quadratic-component. This also means that this MOSFET or MOSFETs is operating in the saturation-mode.

A below-threshold-MOSFET-circuit is a circuit that includes at least one MOSFET the serving as an exponential-component. This also means that this MOSFET or MOSFETs is operating in the below-threshold-mode.

A differential-pair includes two transistors where terminal 3 of one transistor is electrically-connected to terminal 3 of the other transistor.

A matched-transistor-set is a set of two or more transistors where terminal 3 of each transistor is electrically-connected to terminal 3 of all of the other transistors in the set.

Transistor-mismatch is a difference in the transfer function between two different transistors.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

I claim:

1. A method for processing signals in an analog circuit, comprising the steps of:

processing analog input signals using a set of analog circuit components; and enforcing a set of explicit constraints corresponding to a set of implicit constraints to reduce errors in output signals.

2. The method of claim 1, in which the signals represent a set of real variables.

3. The method of claim 1, in which the signals represent a set of complex variables.

4. The method of claim 1, in which the signals represent a set of real variables and complex variables.

5. The method of claim 1, in which the set of constraints are enforced on analog electrical charges.

6. The method of claim 1, in which the set of constraints are enforced on analog voltages.

7. The method of claim 1, in which the set of constraints are enforced on analog currents

8. The method of claim 1, in which the set of constraints are enforced on analog energies.

9. The method of claim 1, in which the set of constraints are enforced on analog magnetic spin.

10. The method of claim 1, in which the analog circuit performs a set of operations selected from a group comprising linear transforms, linearized transforms, unitary transforms, statistical inference, belief propagation, solving differential equations, solving partial differential equations, performing matrix inversions, minimizing a set of functions, Fourier transforms, fast Fourier transforms, wavelet transforms, convolutions, filtering, or correlations.

11. The method of claim 1, in which input signals represent an input vector and the output signal an output vector, and the set of constraints enforces a magnitude of output vector to be identical to a magnitude of the input vector.

12. The method of claim 1, in which the set of constraints includes a summation constraint.

13. The method of claim 12, in which the summation constraint is applied by connecting currents in the analog circuit to a single current source.

14. The method of claim 1, in which the set of constraints includes a Perseval constraint applied to a Fourier transform.

15. The method of claim 1, in which the set of constraints includes a Perseval constraint applied to a fast Fourier transform butterfly circuit.

16. The method of claim 1, in which the set of constraints is enforced after processing the input signals.

17. The method of claim 1, in which the set of analog circuit components includes MOSFETs, and the set of constraints is enforced on the MOSFETs while operating in an above threshold node,

18. The method of claim 1, in which the analog circuit is based on molectronics.

19. The method of claim 1, in which the analog circuit is based on spintronics.

20. The method of claim 1, in which the analog circuit is based on quantum dots.

21. The method of claim 1, in which the analog circuit is based on carbon nanostructures.

22. The method of claim 1, in which the set of constraints includes a constraint based on Kirchhoff's voltage law.

23. The method of claim 1, in which the set of constraints includes a constraint based on Kirchhoff's current law.

24. The method of claim 1, in which the signals represent a set of analog variables, and in which the set of constraints is enforced on overlapping subsets of the variables.

25. The method of claim 1, in which the signals represent a set of analog variables, and in which the set of constraints is enforced on non-overlapping subsets of the variables.

26. The method of claim 1, in which the signals represent a set of analog variables, and in which the set of constraints is enforced successively on subsets of the variables.

27. The method of claim 1, in which the signals represent a set of analog variables, and in which the set of constraints is enforced on overlapping subsets of the variables.

28. The method of claim 1, in which the signals represent a set of analog variables, and in which the set of constraints is enforced on spatially adjacent subsets of the variables.

29. The method of claim 1, in which the signals represent a set of analog variables, and in which the set of constraints is enforced on overlapping subsets of the variables.

30. The method of claim 1, in which the signals represent a set of analog variables, and in which the set of constraints is enforced on hierarchical subsets of the variables.

31. The method of claim 1, in which the signals represent a set of analog variables, and in which the set of constraints is enforced on recursively defined subsets of the variables.

32. The method of claim 1, in which the set of constrains enforce analog states of the processing represented by an analog surface of a unit hyper-sphere.

33. The method of claim 1, in which the signals represent a set of analog variables, and in which the set of constraints is enforced on a sum of squares of the variables, and in which each variable is initially represented by a voltage.

34. The method of claim 1, in which the set of constraints are enforced repeatedly.

35. The method of claim 1, in which the set of analog circuit components of the analog circuit is selected from a group comprising transistors, capacitive elements, quantum dots, MOSFETs, FJETs, HEMTs, or BJTs.

36. The method of claim 35, in which the set of explicit constraints are enforced on the set of analog components.

37. The method of claim 1, in which the set of explicit constraints are enforced on the input signals.

38. The method of claim 1, in which the set of explicit constraints are enforced on analog states of the processing by the set of analog components.

39. The method of claim 1, in which the set of explicit constraints are enforced on the input signals and analog states of the processing by the set of analog components.

40. The method of claim 1, in which the output signals represent a set of real variables.

41. The method of claim 1, in which the output signals represent a set of complex variables.

42. The method of claim 1, in which the output signals represent a set of binary variables.

43. The method of claim 1, in which the output signals represent a set of discrete variables.

44. The methods of claims 1, in which the output signals represent a combination of real, complex, binary, and discrete variables.

45. The method of claim 1, in which the set of constraints is enforced during processing the input signal.

46. The method of claim 1, in which the set of constraints is enforced during and after processing the input signal.

47. The method of claim 1, in which the set of constraints is enforced on an intermediate an analog signals.

48. The method of claim 1, in which the errors are generated by the set of analog circuit components.

49. The method of claim 1, in which the errors are due to varying fabrication processes for the set of analog circuit components.

50. The method of claim 1, in which the errors are due to systematic system faults in the set of analog circuit components,

51. The method of claim 1, in which the errors are due to non-systematic faults in the set of analog circuit components.

52. The method of claim 1, in which the errors are due to parasitic effect in the set of analog circuit components.

53. The method of claim 1, in which the errors are due to mismatch of the set of analog circuit components.

54. The method of claim 1, in which the errors are due to offsets in the set of analog circuit components.

55. The method of claim 1, in which the errors are due to non-linearities in the set of analog circuit components.

56. The method of claim 1, in which the errors are due to environmental conditions in which the set of analog circuit components operate.

57. The method of claim 1, in which the errors are due to noise.

58. The method of claim 1, in which the set of analog circuit components includes MOSFETs, and the set of constraints is enforced on the MOSFETs while operating in a cut-off mode.

59. The method of claim 1, in which the set of analog circuit components includes MOSFETs, and the set of constraints is enforced on the MOSFETs while operating in a below-threshold mode.

60. The method of claim 1, in which the set of analog circuit components includes MOSFETs, and the set of constraints is enforced on the MOSFETs while operating in a triode mode.

61. The method of claim 1, in which the set of analog circuit components includes MOSFETs, and the set of constraints is enforced on the MOSFETs while operating in a linear mode.

62. The method of claim 1, In which the set of analog circuit components includes MOSFETs, and the set of constraints is enforced on the MOSFETs while operating in a saturation mode.

63. The method of claim 1, in which the set of analog circuit components includes BJTs, and the set of constraints is enforced on the BJTs while operating in a cut-off mode.

64. The method of claim 1, in which the set of analog circuit components includes BJTs, and the set of constraints is enforced on the BJTs while operating in a below-threshold mode.

65. The method of claim 1, in which the set of analog circuit components includes BJTs, and the set of constraints is enforced on the BJTs while operating in a triode mode.

66. The method of claim 1, in which the set of analog circuit components includes BJTs, and the set of constraints is enforced on the BJTs while operating in a linear mode.

67. The method of claim 1, in which the set of analog circuit components includes BJTs, and the set of constraints is enforced on the BJTSs while operating in a saturation mode.

68. An apparatus configured to process signals, comprising:

a set of analog circuit components of an analog circuit configured to process analog input signals while enforcing a set of explicit constraints corresponding to a set of implicit constraints to reduce errors in output signals.

69. The apparatus of claim 68, in which the signals represent a set of real variables.

70. The apparatus of claim 68, in which the signals represent a set of complex variables.

71. The apparatus of claim 68, in which the signals represent a set of real variables and complex variables.

72. The apparatus of claim 68, in which the set of constraints are enforced on analog electrical charges.

73. The apparatus of claim 68, in which the set of constraints are enforced on analog voltages.

74. The apparatus of claim 68, in which the set of constraints are enforced on analog currents

75. The apparatus of claim 68, in which the set of constraints are enforced on analog energies.

76. The apparatus of claim 68, in which the set of constraints are enforced on analog magnetic spin.

77. The apparatus of claim 68, in which the analog circuit performs a set of operations selected from a group comprising linear transforms, linearized transforms, unitary transforms, statistical inference, belief propagation, solving differential equations, solving partial differential equations, performing matrix inversions, minimizing a set of functions, Fourier transforms, fast Fourier transforms, wavelet transforms, convolutions, filtering, and correlations.

78. The apparatus of claim 68, in which input signals represent an input vector and the output signal an output vector, and the set of constraints enforces a magnitude of output vector to be identical to a magnitude of the input vector.

79. The apparatus of claim 68, in which the set of constraints includes a summation constraint.

80. The method of claim 79, in which, the summation constraint is applied by connecting currents in the analog circuit to a single current, source.

81. The apparatus of claim 68, in which the set of constraints includes a Perseval constraint applied to a Fourier transform.

82. The apparatus of claim 68, in which the set of constraints includes a Perseval constraint applied to a fast Fourier transform butterfly circuit.

83. The apparatus of claim 68, in which the set of constraints is enforced after processing tire input signals.

84. The apparatus of claim 68, in which the set of analog circuit components includes MOSFETs, and the set of constraints is enforced on the MOSFETs while operating in an above threshold node.

85. The apparatus of claim 68, in which the analog circuit is based on molectronics.

86. The apparatus of claim 68, in which the analog circuit is based on spintronics.

87. The apparatus of claim 68, in which the analog circuit is based on quantum dots.

88. The apparatus of claim 68, in which the analog circuit is based on carbon nanostructures.

89. The apparatus of claim 68, in which the set of constraints includes a constraint based on Kirchhoff's voltage law.

90. The apparatus of claim 68, in which the set of constraints includes a constraint based on Kirchhoff's current law.

91. The apparatus of claim 68, in which the signals represent a set of analog variables, and in which the set of constraints is enforced on overlapping subsets of the variables.

92. The apparatus of claim 68, in which the signals represent a set of analog variables, and in which the set of constraints is enforced on non-overlapping subsets of the variables.

93. The apparatus of claim 68, in which the signals represent a set of analog variables, and in which the set of constraints is enforced successively on subsets of the variables.

94. The apparatus of claim 68, in which the signals represent a set of analog variables, and in which the set of constraints is enforced on overlapping subsets of the variables.

95. The apparatus of claim 68, in which the signals represent a set of analog variables, and in which the set of constraints is enforced on spatially adjacent subsets of the variables.

96. The apparatus of claim 68, in which the signals represent a set of analog variables, and in which the set of constraints is enforced on overlapping subsets of the variables.

97. The apparatus of claim 68, in which the signals represent a set of analog variables, and in which the set of constraints is enforced on hierarchical subsets of the variables.

98. The apparatus of claim 68, in which the signals represent a set of analog variables, and in which the set of constraints is enforced on recursively defined subsets of the variables.

99. The apparatus of claim 68, in which the set of constrains enforce analog states of the processing represented by a analog surface of a unit hyper-sphere.

100. The apparatus of claim 68, in which the signals represent a set of analog variables, and in which the set of constraints is enforced on a sum of squares of the variables, and in which each variable is initially represented by a voltage.

101. The apparatus of claim 68, in which the set of constraints are enforced repeatedly.

102. The apparatus of claim 68, in which the set of analog circuit components of the analog circuit is selected from a group comprising transistors, capacitive elements, quantum dots, MOSFETs, FJETs, HEMTs, or BJTs.

103. The apparatus of claim 68, in which the set of explicit constraints are enforced on the input signals.

104. The apparatus of claim 68, in which the set of explicit constraints are enforced on analog states of the processing by the set of analog components.

105. The apparatus of claim 68, in which the set of explicit constraints are enforced on the input signals and analog states of the processing by the set of analog components.

106. The method of claim 68, in which the set of explicit constraints are enforced on the set of analog components.

107. The apparatus of claim 68, in which the output signals represent a set of real variables,

108. The apparatus of claim 68, in which the output signals represent a set of complex variables.

109. The apparatus of claim 68, in which the output signals represent a set of binary variables.

110. The apparatus of claim 68, in which the output signals represent a set of discrete variables.

111. The apparatus of claim 68, in which the set of constraints is enforced during processing the input signal.

112. The apparatus of claim 68, in which the set of constraints is enforced during and after processing the input signal.

113. The apparatus of claim 68, in which the set of constraints is enforced on intermediate analog signals.

114. The apparatus of claim 68, in which the errors are generated by the set of analog circuit components.

115. The apparatus of claim 68, in which the errors are due to varying fabrication processes for the set of analog circuit components.

116. The apparatus of claim 68, in which the errors are due to systematic system faults in the set of analog circuit components.

117. The apparatus of claim 68, in which, the errors are due to non-systematic faults in the set of analog circuit components.

118. The apparatus of claim 68, in which the errors are due to parasitic effect in the set of analog circuit components.

119. The apparatus of claim 68, in which the errors are due to mismatch of the set of analog circuit components.

120. The apparatus of claim 68, in which the errors are due to offsets in the set of analog circuit components.

121. The apparatus of claim 68, in which the errors are due to non-linearities in the set of analog circuit components.

122. The apparatus of claim 68, in which the errors are due to environmental conditions in which the set of analog circuit components operate.

123. The apparatus of claim 68, in which the errors are due to noise.

124. The method of claim 123, in which the noise is generated by the set of electronic components.

125. The apparatus of claim 123, in which the noise is generated by a channel carrying the analog input signals.

126. The apparatus of claim 68, in which the set of analog circuit components includes MOSFETs, and the set of constraints is enforced on the MOSFETs while operating in a cut-off mode.

127. The apparatus of claim 68, in which the set of analog circuit components includes MOSFETs, and the set of constraints is enforced on the MOSFETs while operating in a below-threshold mode.

128. The apparatus of claim 68, in which the set of analog circuit components includes MOSFETs, and the set of constraints is enforced on the MOSFETs while operating in a triode mode.

129. The apparatus of claim 68, in which the set of analog circuit components includes MOSFETs, and the set of constraints is enforced on the MOSFETs while operating in a linear mode.

130. The apparatus of claim 68, in which the set of analog circuit components includes MOSFETs, and the set of constraints is enforced on the MOSFETs while operating in a saturation mode.

131. The apparatus of claim 68, in which, the set of analog circuit components includes BJTs, and the set of constraints is enforced on the BJTs while operating in a cut-off mode.

132. The apparatus of claim 68, in which the set of analog circuit components includes BJTs, and the set of constraints is enforced on the BJTs while operating in a below-threshold mode.

133. The apparatus of claim 68, in which the set of analog circuit components includes BJTs, and the set of constraints is enforced on the BJTs while operating in a triode mode.

134. The apparatus of claim 68, in which the set of analog circuit components includes BJTs, and the set of constraints is enforced on the BJTs while operating in a linear mode.

135. The apparatus of claim 68, in which, the set of analog circuit components includes BJTs, and the set of constraints is enforced on the BJTSs while operating in a saturation mode.

* * * * *